US010570685B2

(12) United States Patent
Date et al.

(10) Patent No.: US 10,570,685 B2
(45) Date of Patent: Feb. 25, 2020

(54) DOWNHOLE TOOL AND ACTUATION ELEMENT

(71) Applicant: HELIX DRILLING TOOLS LIMITED, Bristol (GB)

(72) Inventors: James Charles Date, Bristol (GB); Malcolm Adrian Abbott, Suffolk (GB)

(73) Assignee: Helix Drilling Tools Limited, Bristol (GB)

( * ) Notice: Subject to any disclaimer, the term of this patent is extended or adjusted under 35 U.S.C. 154(b) by 222 days.

(21) Appl. No.: 15/558,782

(22) PCT Filed: Mar. 16, 2016

(86) PCT No.: PCT/GB2016/050713
§ 371 (c)(1),
(2) Date: Sep. 15, 2017

(87) PCT Pub. No.: WO2016/146998
PCT Pub. Date: Sep. 22, 2016

(65) Prior Publication Data

US 2018/0073315 A1 Mar. 15, 2018

(30) Foreign Application Priority Data

Mar. 17, 2015 (GB) ..... 1504426.6

(51) Int. Cl.
*E21B 21/10* (2006.01)
*E21B 34/14* (2006.01)
*E21B 34/00* (2006.01)

(52) U.S. Cl.
CPC ..... *E21B 21/103* (2013.01); *E21B 34/14* (2013.01); *E21B 2034/002* (2013.01)

(58) Field of Classification Search
CPC .. E21B 21/103; E21B 34/14; E21B 2034/002; F16K 11/00

(Continued)

(56) References Cited

U.S. PATENT DOCUMENTS 3,166,098 A * 1/1965 Jennings ..... F16K 11/0873 137/625.43
3,837,403 A 9/1974 Mott
(Continued)

FOREIGN PATENT DOCUMENTS

EP 1872845 A1 1/2008
EP 2333232 A2 6/2011
(Continued)

OTHER PUBLICATIONS

International Search Report and Written Opinion for PCT/GB2016/050713 dated Sep. 2, 2016 (20 pages).

*Primary Examiner* — Nicole Coy
*Assistant Examiner* — Yanick A Akaragwe
(74) *Attorney, Agent, or Firm* — Bejin Bieneman PLC

(57) ABSTRACT

A downhole circulation tool includes: a housing having an axially extending delivery bore for conveying a drilling mud flow therethrough, the housing having a circulation port for discharging drilling mud; and a valve member rotatably disposed within the housing, the valve member comprising a through-flow channel and a circulation channel. The valve member is rotatable between a through-flow position in which the through-flow channel is arranged to convey drilling mud flow from an upstream portion of the delivery bore to the downstream portion of the delivery bore, and a circulation position in which the circulation channel is arranged to convey drilling mud from the upstream portion of the delivery bore to the circulation port to discharge drilling mud from the housing. There is also disclosed a downhole tool comprising a unidirectional drive mechanism, an actuation element for a downhole tool, and a method of operating a downhole tool.

15 Claims, 12 Drawing Sheets

(58) Field of Classification Search
USPC ..... 251/315.16
See application file for complete search history.

(56) References Cited

U.S. PATENT DOCUMENTS

| | | | | |
|---|---|---|---|---|
| 4,716,968 | A | 1/1988 | Pringle | |
| 9,719,603 | B2 * | 8/2017 | Aboujaib | F01D 17/10 |
| 2008/0093080 | A1 | 4/2008 | Palmer | |
| 2012/0006553 | A1 | 1/2012 | Korkmaz | |
| 2012/0160488 | A1 | 6/2012 | Fould et al. | |
| 2014/0124195 | A1 | 5/2014 | Tahoun | |
| 2014/0158433 | A1 | 6/2014 | Bisset et al. | |

FOREIGN PATENT DOCUMENTS

| | | | |
|---|---|---|---|
| EP | 2492437 | A2 | 8/2012 |
| GB | 2311316 | A | 9/1997 |
| GB | 2323867 | A | 10/1998 |
| GB | 2454895 | A | 5/2009 |
| WO | 2008156369 | A1 | 12/2008 |
| WO | 2013154420 | A2 | 10/2013 |

* cited by examiner

DOWNHOLE TOOL AND ACTUATION ELEMENT

This application is a national stage of, and claims priority to and all advantages of, International Application No. PCT/GB2016/050713, filed on Mar. 16, 2016, which claims priority to and all advantages of Great Britain Application No. 1504426.6, filed on Mar. 17, 2015, both of which are hereby incorporated by reference in their entirety.

The disclosure relates to a downhole tool, in particular a downhole circulation tool, and an actuation element for a downhole tool.

Downhole tools are typically used in oil and gas exploration, in which bores are drilled from the Earth's surface many thousands of metres into the Earth's crust to gain access to subsurface hydrocarbon-rich formations or reservoirs.

FIG. 1 shows a simplified view of a typical bore hole 110 being drilled through the earth's crust 112 using a typical drill string assembly 114. The drill string 114 comprises a plurality of tubular sections connected to a drill bit 116 disposed at the lower end of the drill string 114. The lower end of the drill string 114 is commonly referred to as the Bottom Hole Assembly (BHA) 132. The BHA 132 is typically made up of a plurality of tools or sub-assemblies (subs) which may include stabilisers 134, Measurement While Drilling (MWD) (not shown), Logging While Drilling (LWD) (not shown), mud motors (not shown) and circulation tools 127.

Rotation of the drill bit 116 is typically achieved either by rotating the drill string 114 at the surface or via a mud motor (not shown) located above the drill bit 116. In use, a drilling fluid; often referred to as a drilling mud 118, is pumped from the surface through the drill string 114. The drilling mud 118 exits the drill string 114 at the drill bit 116 through jetting nozzles 120 and then flows back to the surface via the bore hole annulus 122 defined between the drill string outer wall 124 and the bore hole 110 or a casing/liner within the bore hole 110.

The drilling mud 118 provides lubrication and cooling to the drill bit 116 and also provides a method by which drilling cuttings 126 can be carried away from the drill bit 116, back through the bore hole annulus 122 to the surface.

A known problem in typical bore holes, such as the bore hole 110 of FIG. 1, is that the flow rate of drilling mud 118 returning through the bore hole annulus 122 to the surface may not be sufficient to carry all of the drilling cuttings 126. Extended reach, deviated and slim-diameter bore holes may be particularly susceptible to such problems. This can result in the drilling cuttings 126 settling in the bore hole annulus 122, especially in horizontally-oriented sections, thereby restricting the clearance between the drill string 114 and the bore hole 110 which may cause the drill string 114 to stick or jam and the upward flow of drilling cuttings 126 to be blocked.

In order to alleviate this problem, it is known to include one or more circulation tools 127 above the drill bit 116 in the BHA 132 or at other positions along the drill string 114. The circulation tool 127 is operable to divert drilling mud 118 from the BHA 132 into the bore hole annulus 122 before it reaches the jetting nozzles 120 in the drill bit 116. This bypass or circulation flow of drilling mud 118 can be used to clear accumulated drilling cuttings 126 from the bore hole annulus 122, for example, by increasing flow velocities and turbulence in the bore hole annulus 122, thereby allowing transportation and cleaning of the drilling cuttings 126 up to the surface of the bore hole 110.

Downhole circulation tools are also used for a number of other purposes in downhole operations, including: the injection of relatively higher density conditioning drilling mud for formation pressure balancing and bore hole stability; and the injection of Lost Circulation Material (LCM) when the bore hole encounters porous formations (in particular, coarse LCM), commonly known as LCM spotting.

All applications of circulation tools require the tool to be actuated to divert the drilling mud from the bore within the drill string into the bore hole annulus.

Existing circulation tools typically comprise a sliding sleeve valve operable to open and close a flow port in the wall of the circulation tool so that drilling mud may flow from the drill string into the bore hole annulus. However, such known circulation tools may encounter a number of problems or operational deficiencies. In particular, drilling mud typically turns abruptly in the tool to exit the drill string in a lateral jet through the sleeve and flow port, resulting in flow separation and high pressure losses (and consequently, a high pumping load/pressure). Further, the high velocity jet within the tool can lead to erosion and/or washing of the components within the tool, such as the sleeve valve itself, which may lead to equipment failure. Further, the high velocity lateral jet can erode the bore hole wall, resulting in bore hole instability and/or washout. Further still, movement of the sliding sleeve valve across the flow ports, and/or the suction caused by high velocity flow though the flow ports can cause damage or extrusion of the seals fitted around the sliding sleeve valve.

Accordingly, it is desirable to provide an improved downhole circulation tool.

Further, known circulation tools incorporating sliding sleeve valves are typically actuated using an actuation ball or dart, drill string weight actuation, flow pressure actuation, bore hole annulus pressure actuation and electrical actuation; with actuation by an actuation ball being particularly popular.

In a ball-actuated circulation tool, such as the circulation tool 127 of FIG. 1, a metal or plastic actuation ball (or other actuation element) is pumped with the drilling mud 118 through the drill string 114 to actuate a sliding sleeve valve. Actuation of the sliding sleeve valve occurs when the actuation ball lands on a seat positioned within the sliding sleeve. The blockage of the drilling mud flow caused by the seated actuation ball creates a differential pressure across the actuation ball, which in turn causes the sliding sleeve, which is coupled to the seat, to move axially within the circulation tool, thereby opening the flow ports 130 and allowing drilling mud 118 to flow from the drill string 114 into the bore hole annulus 122, thus bypassing the lower tools of the BHA 132. This is often referred to as the circulation tool bypass mode or circulation mode.

The actuation ball may subsequently be forced past the seat by applying an increase in drilling mud pressure across the actuation ball, causing either the actuation ball or the seat to deform. The sliding sleeve is then returned to its original 'through-flow' mode by the action of a biasing spring, allowing drilling mud to flow through the BHA towards the drill bit once more.

However, known ball-actuated circulation tools typically suffer from a number of problems or operating deficiencies. Typically, the number of cycles between the through-flow and bypass modes is limited by the capacity of a ball catcher used to catch the spent balls below the circulation tool. Further, actuation balls received in the ball catcher can prevent access with wireline or fishing tools below the circulation tool. Further, a sliding sleeve valve may return to its original 'through-flow' mode sooner than desired if the pressure is not controlled properly, or if the ball is too flexible or not sufficiently resistant to degradation.

A number of prior art circulation tools have sought to overcome the limitations of using solid activation balls as described above, by replacing them with disintegratable (i.e. able to disintegrate) actuation balls which are either formed from an erodible bonded mixture or from a spherical blown hollow borosilicate ball filled with gas or liquid. Accordingly, no ball catcher is required.

However, the use of known disintegratable actuation balls may result in a number of problems or operating deficiencies. In particular, the disintegratable actuation balls can prematurely disintegrate whilst being pumped down the drill string or on the seat, resulting in the circulation tool failing to actuate or returning to the original through-flow mode sooner than desired. Further, the disintegratable actuation ball may fail to block the drilling mud flow below the circulation tool as intended, resulting in split flow to the bore hole annulus and drill bit, which may cause reduced hole cleaning and the inability to bypass the lower tools of the BHA, which may be particularly problematic for operations such as LCM spotting. Further, the duration of the bypass or circulation mode can be limited by the time it takes for the disintegratable actuation ball to dissolve once seated on the sliding sleeve valve seat, and may also vary depending on the drilling mud flow rate used, which may be factors outside of the control of the operator.

Accordingly, it is desirable to provide an improved actuation device for a downhole circulation tool.

According to a first aspect of the disclosure there is provided a downhole circulation tool comprising: a housing having an axially extending delivery bore for conveying a drilling mud flow therethrough, the housing having a circulation port for discharging drilling mud; and a valve member rotatably disposed within the housing, the valve member comprising a through-flow channel and a circulation channel; wherein the valve member is rotatable between a through-flow position in which the through-flow channel is arranged to convey drilling mud flow from an upstream portion of the delivery bore to the downstream portion of the delivery bore, and a circulation position in which the circulation channel is arranged to convey drilling mud from the upstream portion of the delivery bore to the circulation port to discharge drilling mud from the housing.

The upstream portion of the delivery bore may be the portion arranged to deliver drilling mud flow to the through-flow channel when the valve member is in the through-flow position, and the downstream portion of the delivery bore may be the portion arranged to receive drilling mud flow from the through-flow channel when the valve member is in the through-flow position. In a typical operational environment, the upstream portion of the delivery bore is the portion above (and adjacent to) the valve member, whereas the downstream portion is the portion below (and adjacent to) the valve member.

The circulation port may be configured to discharge drilling mud into the space around the downhole circulation tool, such as a well bore annulus defined between the well bore and the tool.

The through-flow channel may extend substantially longitudinally through the valve member, such as diametrically (or between the antipodes of the valve member). The through-flow channel may extend along a direction perpendicular to the axis of rotation of the valve member. The through-flow channel may have antipodal openings defining through-flow inlets and outlets respectively depending on the orientation of the valve member.

The valve member may be a ball valve member. The valve member may be configured to prevent drilling mud flow to the downstream portion of the delivery bore.

The circulation channel and through-flow channel of the valve member may not intersect one another. In other words, the circulation channel and through-flow channel may be separate or discrete from one another.

There may be a plurality of circulation channels, each arranged to deliver drilling mud to a respective circulation port in the housing when the valve member is in the circulation position. Each circulation channel may have a respective circulation inlet. Alternatively, at least two or all of the circulation channels may share a common circulation inlet. There may be four circulation channels. The or each circulation channel may be configured to at least partly reverse the direction of the drilling mud between the circulation inlet and the circulation outlet. The or each circulation channel may be configured to turn a fluid flow passing therethrough through an angle of more than 90°. The or each circulation channel may be configured so that flow received along a first direction defined by and/or through the circulation inlet is discharged along a second direction defined by and/or through the respective circulation outlet having a component parallel and opposite to the first direction, and is thereby at least partially reversed.

The or each circulation channel may be arranged to turn the drilling mud flow flowing therethrough such that, in use, drilling mud is discharged to the respective circulation port along a circulation channel discharge direction having an axial component parallel and opposite to the direction of flow in the axially extending delivery bore. Accordingly, when the downhole circulation tool is oriented substantially vertically such that drilling mud flows substantially downwardly through the delivery bore, the or each circulation channel discharges mud to the respective circulation port along a circulation channel discharge direction having an upward component (when the valve member is in the circulation position).

The circulation channel discharge direction may be determined by the profile of the circulation channel up to the circulation outlet. The circulation channel discharge direction may extend obliquely with respect to a delivery direction along which drilling mud is received from the upstream portion of the delivery bore to the circulation inlet of the circulation channel.

The or each circulation channel may be configured to discharge drilling mud along a circulation channel discharge direction having a tangential component with respect to the longitudinal axis of the tool, housing or delivery bore (which may be coaxial). Accordingly, when the downhole circulation tool is oriented substantially vertically such that drilling mud flows substantially downwardly through the delivery bore, the or each circulation channel discharges drilling mud into an annulus surrounding the downhole circulation tool along a direction having upward and tangential components so as to form a helical flow path in the annulus (when the valve member is in the circulation position).

The or each circulation channel may be configured so that, in use in the circulation position, drilling mud is discharged to the respective circulation port along a circulation channel discharge direction having a tangential component.

The or each circulation channel may be configured so that the circulation channel discharge direction has a radial component. The tangential and/or radial component may be with respect to a longitudinal axis of the downhole circulation tool, such as the axis of the delivery bore or the housing.

The or each circulation channel may be configured to receive drilling mud along a substantially axial circulation channel inflow direction (i.e. parallel or coaxial with the axis of the delivery bore and/or the longitudinal axis of the downhole circulation tool and/or the housing).

The or each circulation channel may be curved along its length. The or each circulation channel may be curved along its length between the circulation inlet and the circulation outlet so that a drilling mud flow received therein is gradually turned as it flows towards the circulation outlet. Accordingly, the flow may be turned with minimal or no flow separation.

An opening of the through-flow channel and the or each circulation inlet may be angularly spaced apart by substantially 90° with respect to the rotational axis of the valve member. An opening of the through-flow channel and the or each circulation inlet may define respective inflow directions that are perpendicular to one another, such that the angle of rotation of the valve member from the through-flow position to the circulation position is 90°.

There may be a first circulation channel and a second circulation channel each having respective circulation inlets, wherein the first and second circulation channels do not intersect one another, and wherein the circulation inlet of the second circulation channel is antipodal with respect to the circulation inlet of the first circulation channel. Accordingly, the valve member may have inlets to the through-flow channel and a circulation channel alternately spaced apart at 90° intervals, such that the valve member may alternate from a through-flow position and a circulation condition by rotating 90° in any direction, including successive rotations of 90° in one direction only.

There may be a first circulation manifold comprising a first plurality of circulation channels having a first common circulation inlet (or adjacent first circulation inlets), and a second circulation manifold comprising a second plurality of circulation channels having a second common circulation inlet (or adjacent second circulation inlets). The first and second common circulation inlets (or first and second groups of adjacent circulation inlets) may be antipodal with respect to each other (i.e. they may oppose each other along a direction through the centre of the valve). The circulation channels of the first manifold may not intersect the circulation channels of the second manifold (i.e. they may be separate or discrete).

The valve member may comprise a plurality of circulation channels and there may be a corresponding plurality of circulation ports in the housing.

The or each circulation port may be configured to turn a drilling mud flow flowing therethrough. In other words, the circulation port may be configured to change the direction of the drilling mud flowing therethrough. The circulation port may be configured to turn the flow of drilling mud received therein so that an axial component (corresponding to the axis of the delivery bore) of the drilling mud flow increases in magnitude as the drilling mud flows through the circulation port. The circulation port may be configured to turn the flow of drilling mud received therein so that a tangential component (relative to the axis of the delivery bore) of the drilling mud flow increases in magnitude as the drilling mud flows through the circulation port.

The or each circulation port may be configured to discharge drilling mud along a port discharge direction having a tangential component and an axial component parallel and opposite to the direction of flow in the axially extending delivery bore.

The or each circulation channel and the or each circulation port may be configured so turn a drilling mud flow flowing through the respective circulation channel and circulation port successively between the respective circulation inlet and the respective exit of the circulation port. In other words, the or each circulation channel and the or each circulation port may be configured to at least partly reverse the direction of the drilling mud between the circulation inlet and the exit of the circulation port, for example by turning it through an angle of at least 90°.

The or each circulation channel and the or each circulation port may be arranged to turn the drilling mud flow flowing therethrough such that, in use, drilling mud is discharged from the respective circulation port along a circulation port discharge direction having an axial component parallel and opposite to the direction of flow in the axially extending delivery bore. Accordingly, when the downhole circulation tool is oriented substantially vertically such that drilling mud flows substantially downwardly through the delivery bore, the or each circulation channel and respective circulation port discharges mud along a circulation port discharge direction having an upward component (when the valve member is in the circulation position).

A component of the downhole circulation tool defining an upstream portion of the delivery bore adjacent to the valve member and/or a component of the downhole circulation tool defining a downstream portion of the delivery bore adjacent to the valve member may be configured to seal with the valve member. For example, the component may be biased against the valve member, for example, by a resilient biasing means, such as a spring.

According to a second aspect of the disclosure, there is provided a valve member for a downhole circulation tool in accordance with the first aspect of the disclosure.

According to a third aspect of the disclosure there is provided a downhole tool comprising: an axially extending housing; a piston member axially movable within the housing between at least a resting configuration to which it is biased and a depressed configuration, the piston member having a passageway for a drilling mud flow and a seat for receiving an actuation element, wherein the piston member is configured so that, in use, reception of an actuation element on the seat at least partially occludes the passageway so that the piston member is displaced from the resting configuration towards a depressed configuration; a tool device movable between multiple positions; a unidirectional drive mechanism disposed between the piston member and the tool device and configured so that movement of the piston member from the depressed configuration to the resting configuration causes the tool device to move from a first position to a second position.

The unidirectional drive mechanism may be configured so that movement of the piston member only causes the tool device to move when the piston member moves in a direction from the depressed configuration to the resting configuration. In other words, the unidirectional drive mechanism may be configured so that movement of the piston member from the resting configuration to the depressed configuration does not cause the tool device to move. Yet further, the unidirectional drive mechanism may be configured so that in a piston actuation cycle, comprising movement of the piston member in a depression direction from the resting configuration to the depressed configuration and subsequent movement in a return direction from the depressed configuration to the resting configuration causes one-way movement of the tool device only (i.e. from a first position to a second position only), which movement results from the movement of the piston member from the depressed configuration to the resting configuration.

The piston member may be configured so that in use when an actuation element is received on the seat to at least partially occlude the passageway, the piston member is displaced from the resting configuration towards the depressed configuration owing to hydraulic pressure acting on the piston member via the actuation element. In this arrangement, the actuation element and piston member together operate as a piston.

The piston member may be configured to return to the resting configuration once the actuation element passes through the seat, for example, under a biasing force. For example, the piston may be biased by a spring.

The tool device may be a valve member, such as a ball valve member for alternating between a through-flow configuration and a circulation configuration of a downhole circulation tool.

The unidirectional drive mechanism may be configured so that movement of the piston member from the depressed configuration to the resting configuration causes the tool device to move by a predetermined tool displacement from the first position to the second position. In the depressed configuration the piston member may be displaced from the resting configuration by at least a threshold piston displacement, and the unidirectional drive mechanism may be configured to move the tool device between positions only in response to movement in the return direction from the depressed configuration.

The threshold piston displacement may be predetermined. The unidirectional drive mechanism may be configured to rotate the tool device about an axis perpendicular to the axis of the tool. In general, the threshold piston displacement will be set dependent on the geometry of the tool as it is related to the lever arm required to rotate the tool device, and will therefore increase with increasing tool geometry. For example, in a circulation tool having an 80 mm outer diameter the threshold piston displacement may be 13 mm.

The axis of the tool may be a longitudinal axis. Alternatively, the unidirectional drive mechanism may be configured to move the tool device in an axial direction.

The tool device may be configured to move in sequence to a plurality of successive positions, and the unilateral drive mechanism may be configured so that movement of the piston member from the depressed configuration to the resting configuration causes the tool device to move in one direction only from one position to the next. Each of the successive positions may be predetermined. There may be an indexing arrangement for indexing the tool device to the positions.

The unidirectional drive mechanism may comprise a unidirectional clutch. The unidirectional clutch may be configured to overrun in a direction corresponding to movement of the piston member in a depression direction from the resting configuration to the depressed configuration. In other words, the clutch may be configured so that it does not drive or cause the tool device to move as the piston moves from the resting configuration towards the depressed configuration.

The clutch may comprise a drive part coupled to or integral with the piston member and a driven part coupled to or integral with the tool device. One of the drive part and the driven part may have a plurality of spaced apart engagement features for engaging with a corresponding feature of the other part. The spacing between the engagement features may correspond to the predetermined tool displacement.

The clutch may be configured so that, when the drive part is engaged with the driven part, movement of the piston member in a direction towards the resting configuration (e.g. from the depressed configuration) causes the driven part to move.

The threshold piston displacement may correspond to relative movement between the drive part and the driven part that causes overrunning movement of one engagement feature. The threshold piston displacement may be greater than the spacing between the engagement features.

The clutch may be configured so that movement of the piston member in a return direction from the threshold piston displacement to the resting configuration causes the drive part to engage with the driven part and move together by an amount corresponding to the spacing between the engagement features. The clutch may be configured so that movement of the driven part by an amount corresponding to the spacing between the engagement features causes the tool device to move the predetermined tool displacement.

The clutch device may be configured so that, with the piston member in the resting configuration the drive part is engaged with the driven part. Further, the tool device may comprise a stop for preventing extending movement of the piston member from the resting configuration in a direction away from the depressed configuration, such that the stop prevents the tool device moving in the return direction when the piston member is in the resting configuration.

The downhole tool may further comprise a piston displacement stop configured to prevent displacement of the piston member from the resting configuration by a displacement corresponding to the threshold piston displacement in addition to the spacing between the engagement features, such that movement of the tool device as the piston member returns to the resting configuration is limited to the predetermined tool displacement.

The stop may be configured to prevent displacement of the piston member beyond the threshold piston displacement, or beyond a factor of up to 1.1, up to 1.25, up to 1.5, up to 1.75 or up to 1.9 times the threshold piston displacement. The stop may be configured to prevent displacement of the piston member by twice the threshold piston displacement. Accordingly, the piston member may be constrained so that only one engagement feature of the clutch device can be overrun as the piston member is displaced in a depression direction. Accordingly, any displacement beyond the threshold piston displacement will not result in movement of the tool device beyond the predetermined tool displacement.

The predetermined tool displacement may be an angular displacement of 90°. The tool device may be configured to rotate fully, so that it can rotate to unlimited successive positions. In other embodiments, the predetermined tool displacement may be other angular displacements, such as 45°, 60°, 120° and 180°. There may be an indexing arrangement configured to index the tool device to successive positions, for example, the indexing arrangement may comprise corresponding formations on the tool device and a counteracting part mounted within the housing.

The downhole tool may further comprise a stop coupled to the piston member and configured to prevent movement of the tool device in at least a direction from the first position towards the second position when the piston member is in the resting configuration. The stop may be arranged to engage with the tool device when the piston member is in the resting configuration. The stop may be arranged to disengage from the tool device when the piston member is displaced from the resting configuration.

The clutch may comprise an overrunning pawl clutch mechanism. The overrunning pawl clutch mechanism may comprise a pawl carrier and a tooth carrier, and may be configured so that a pawl of the pawl carrier overruns a corresponding tooth carrier in a first direction of relative movement as the piston is displaced from the resting configuration to the depressed configuration (i.e. downwardly in a typical installation). The pawl clutch mechanism may be configured so that the pawl passes relatively over a tooth edge of the tooth carrier as the piston member is displaced to the piston displacement threshold or beyond, and so that the pawl subsequently engages with the corresponding tooth in a second direction of relative movement as the piston member returns towards the primary position. The pawl may be provided with a pawl spring biasing it to a position for engaging with a tooth of the tooth carrier.

The tooth carrier may be fixed with respect to the tool device so that the tool device is constrained to move with the tooth carrier. The tooth carrier may be integrally formed with the tool device. There may be a plurality of pawls carried by the pawl carrier. The tooth carrier may comprise a number of teeth corresponding to a plurality of predetermined positions of the tool device. Alternatively, the tooth carrier may be driven by movement of the piston, and the tool device may be constrained to move with the pawl carrier, such that the tooth carrier engages with the pawl carrier when the piston moves beyond the piston displacement threshold.

Where the clutch and tool device are configured for rotary movement, the tooth carrier may comprise a number of teeth corresponding to a predetermined angular displacement of the tool device. For example, the tooth carrier may have four teeth where there are four predetermined positions of the tool device corresponding to angular displacements therebetween of 90°.

There may be more than one clutch mechanism configured to operate in unison. For example, where the clutch and tool device are configured for rotary movement, there may be two coaxially arranged clutch mechanisms supporting opposite ends of the tool device.

The downhole tool may further comprise a slide element arranged to move longitudinally with the piston member (and which may be integrally formed with the piston), and arranged to engage a pin coupled to or integrally formed with the clutch mechanism to drive a part of the clutch mechanism. For example, the slide element may be arranged to engage with the pin so as to rotate a drive part of the clutch mechanism, which may be the pawl carrier of the clutch mechanism or the tooth carrier of the clutch mechanism.

It will be appreciated that other types of clutch mechanisms may be employed.

According to a fourth aspect of the disclosure, there is provided a downhole tool in accordance with the third aspect of the disclosure, wherein the tool device is in accordance with the second aspect of the disclosure. The downhole tool may also be in accordance with the first aspect of the disclosure.

According to a fifth aspect of the disclosure, there is provided an actuation element for a downhole tool, wherein the actuation element is configured to disintegrate under pressure in the downhole tool, and comprises phyllosilicate. The actuation element may comprise a clay. The actuation element may comprise montmorillonite. The actuation element may comprise bentonite. The actuation element may comprise sodium bentonite, calcium bentonite, aluminium bentonite and/or potassium bentonite. The bentonite may constitute between 10-60% of the actuation element by volume, for example, 10-50%, 10-40%, 10-30%, 20-40% or approximately 20%.

The actuation element may comprise a substantially spherical ball.

The actuation element may comprise salt portions, for example, comprising calcium carbonate or calcium sulphide. The salt portions may constitute 25-90% of the actuation element by volume, for example 40-70%, 50-60% or substantially 50%.

The actuation element may comprise a body comprising a mixture of the salt portions and the clay. The mixture may be substantially uniform throughout the body. Alternatively, the actuation element may comprise a body comprising clay portions separated by salt portions. For example, the salt portions may form channels at least partially separating the clay portions. The salt portions may be in the form of layers or coatings around the clay portions. Accordingly, as the salt portions degrade or dissolve, the clay portions of the body may separate so that the actuation element disintegrates. For example, in a water-based drilling-mud, the water in the mud may help to dissolve the salt portions. In an oil-based drilling mud, the oil may be absorbed into and around the salt portions and mechanically degrade the salt portions and the actuation element as a whole. The salt portions may include filler material, such as wood dust. Other filler materials could be used, such as cedar bark and shredded cane stalks. The filler material comprise flake materials, such as mica, portions of cellophane sheeting or plastic. The filler material may comprise granular or powdered material (such as ground limestone, marble, wood, nut hulls, corncobs and cotton hulls). Filler materials may be selected from the group of materials known for use as lost circulation material (LCM). The proportion of salt (such as calcium carbonate or calcium sulphide) relative to filler material in the salt portions may be from 10% salt to 100% salt by volume. Accordingly, salt may constitute between 2.5% and 90% of the actuation element by volume.

The actuation element may comprise a protective outer coating. The protective outer coating may form an outer layer around the body. The protective outer coating may comprise a material selected from the group consisting of epoxides, glycidyl, oxirane groups, benzoxazines polyimides, bismaleimides and cyanate esters. The protective outer coating may constitute 5-40% of the actuation element by volume. For example, the protective outer coating may constitute 10-30% or approximately 20% of the actuation element by volume.

For example, an actuation element may be composed of a coating constituting 10% by volume, bentonite constituting 30% by volume, and salt portions constituting 60% by volume. Sodium chloride salt may account for 50% of the salt portions, with the remaining 50% being a filler material.

The actuation element may be formed from pre-form material in a compression forming process. At least the body may be formed from the pre-form material. The pre-form material may comprise a clay, and optionally a salt, as described above.

According to a sixth aspect of the disclosure there is provided a method of manufacturing an actuation element in accordance with the fifth aspect of the disclosure, the method comprising compressing a pre-form material to form a body for the actuation element. The compression force in the manufacturing method may be sufficient for the pre-form material to bond.

The method may further comprising finishing or trimming the formed body by removing material from it, for example by tumble finishing or machining, such as milling or turning. The method may further comprise coating the body of the actuation element with a protective outer coating.

The pressure load during compression forming may be at least 50 MPa, for example between 90 MPa and 1800 MPa. The pressure required depends on the strength required from the actuation element, which itself may depend on the force applied through the actuation element to drive the piston in use. The applicant has produced a 27mm diameter actuation element using a compression load of approximately 500 MPa. The pre-form may be compressed using a forming apparatus comprising two die parts each having a hemispherical recess.

According to a seventh aspect of the disclosure there is provided a method of operating a downhole tool in accordance with the third aspect or fourth aspects of the disclosure, comprising: pumping drilling mud through a delivery bore of the housing so that drilling mud flows through the passageway in the piston member; inserting an actuation element in accordance with the fifth aspect of the disclosure into the drilling mud flow so that the actuation element seats on the seat of the piston member, thereby causing the piston member to be displaced from the resting configuration to the depressed configuration; causing or allowing the actuation element to disintegrate so that it passes through the seat, such that the piston member returns to the resting configuration causing the tool device to move from the first position to the second position.

Causing or allowing the actuation element to disintegrate may comprise any of: waiting for the actuation element to degrade; and/or maintaining drilling mud pressure above a predetermined threshold; increasing drilling mud pressure with respect to the pressure of the drilling mud when the actuation element was received on the seat.

The disclosure may comprise any combination of the above features and limitations, except such combinations are mutually exclusive.

The disclosure will now be described, by way of example, with reference to the accompanying drawings, in which:

FIG. 1 shows a cross-sectional view of a bore hole with a drill string installed for drilling, including a circulation tool;

FIG. 2*a* shows a side view of a circulation tool according to the disclosure;

FIG. 2*b* shows a cross-sectional side view of the circulation tool in the through flow configuration (section along A-A of FIG. 2*a*);

FIG. 2*c* shows a cross-sectional side view of the circulation tool in the through flow configuration (section along B-B of FIG. 2*b*);

Figure 6A:
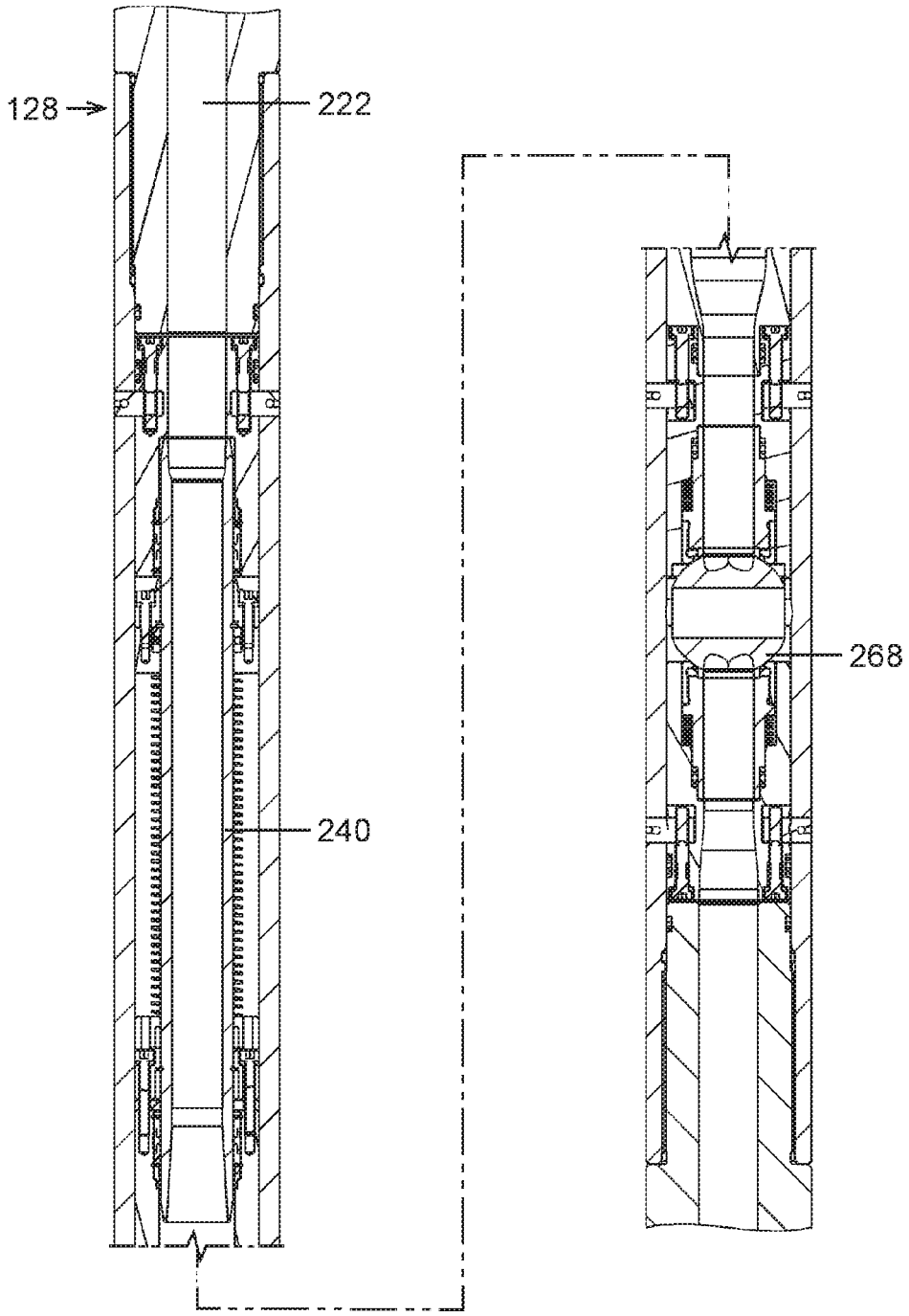
Figure 6B:
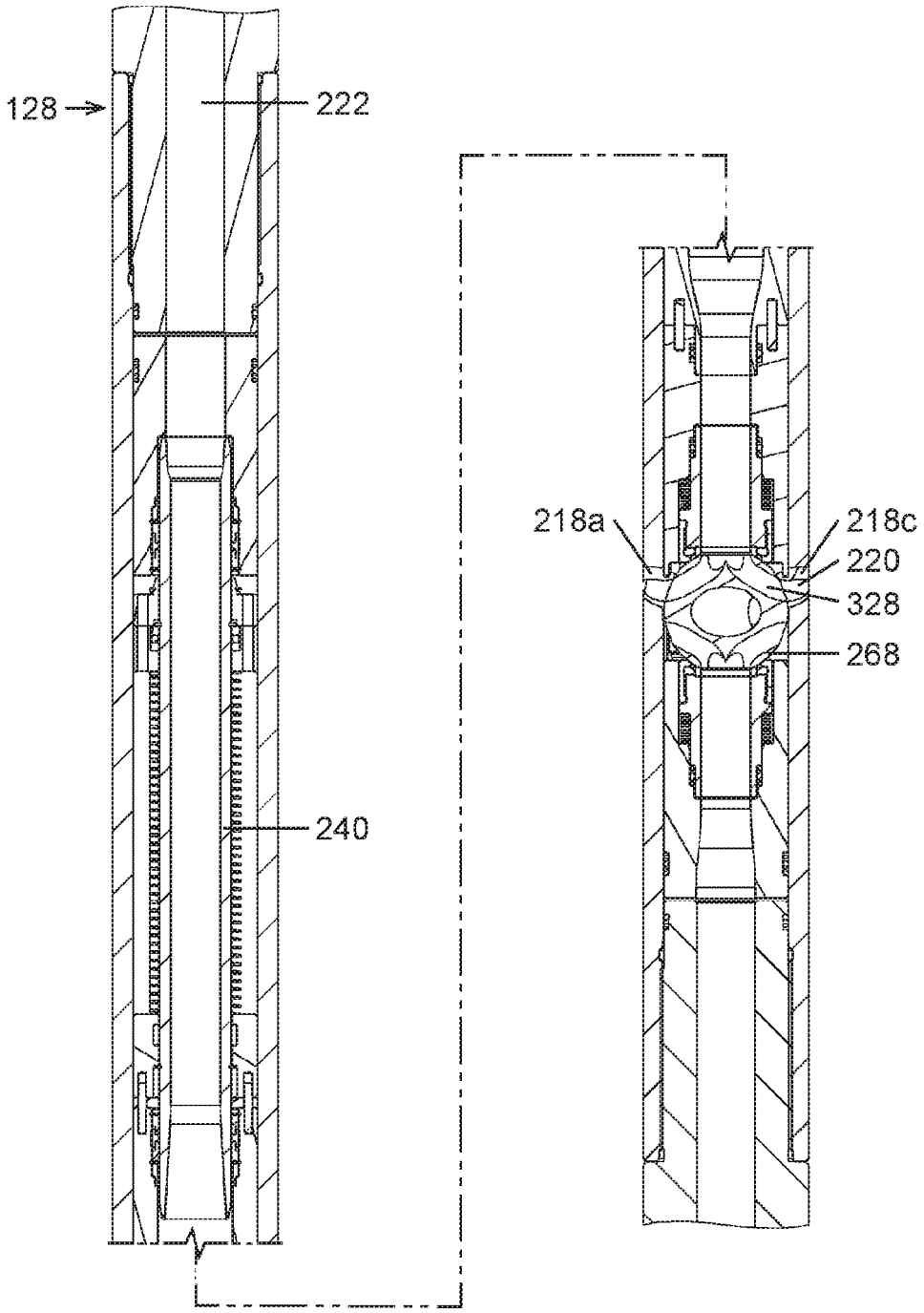
Figure 7:
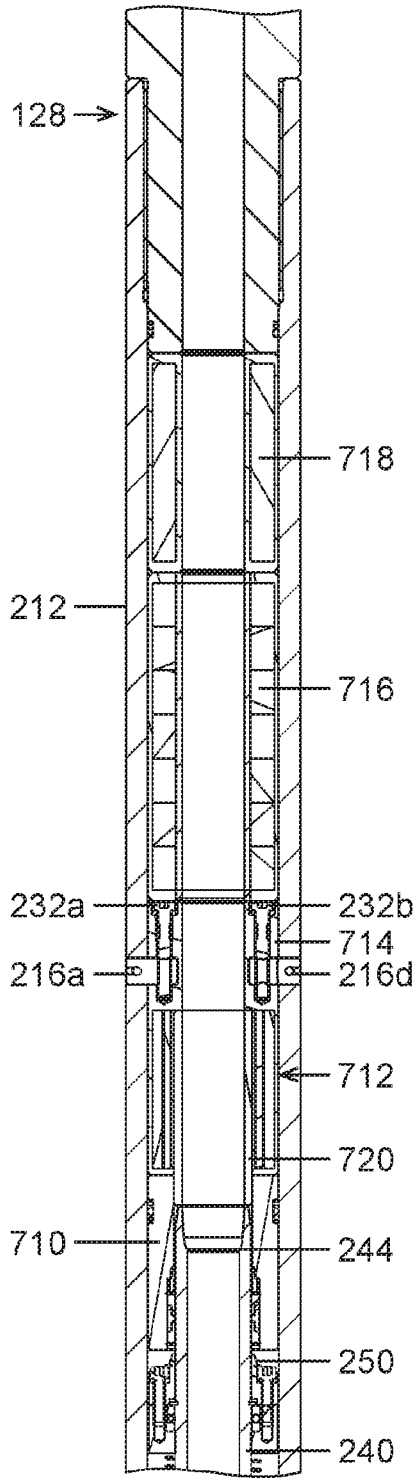
Figure 8:
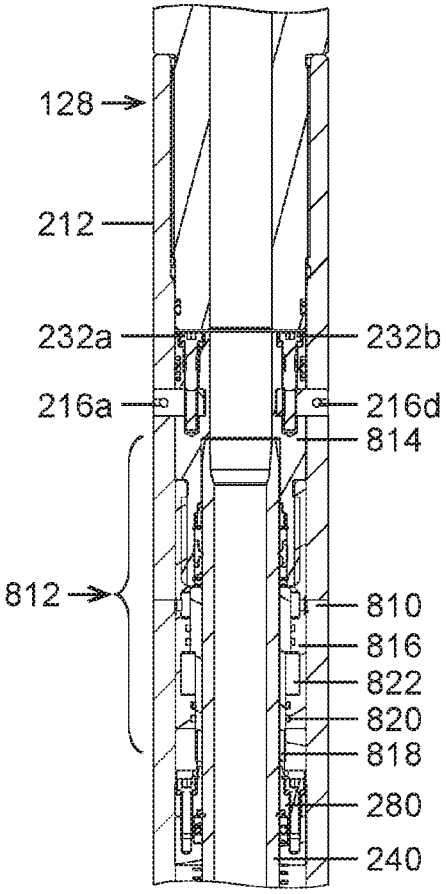
Figure 9:
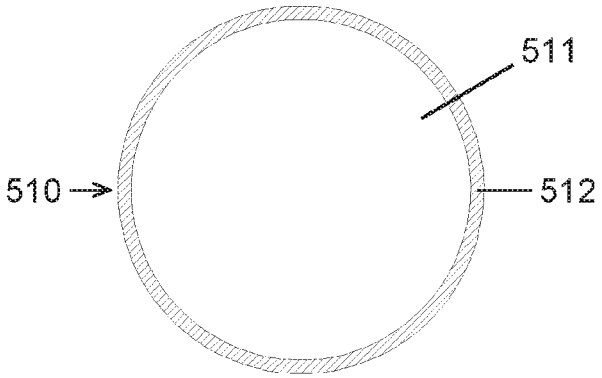

FIG. 6*a* shows a cross-sectional side view of the circulation tool in the circulation position (section along A-A of FIG. 2*a*), with the tubular actuating piston member in the resting configuration;

FIG. 6*b* shows a cross-sectional side view of the circulation tool in the circulation position taken along a staggered cross-section line which cuts through the circulation channels of the valve member;

FIG. 7 shows a cross-sectional side view of the upper section of an electromagnetically actuated circulation tool;

FIG. 8 shows a cross-sectional side view of the upper section of an annulus pressure actuated circulation tool; and FIG. 9 shows a cross-sectional view of the disintegratable actuation element.

Figure 1:
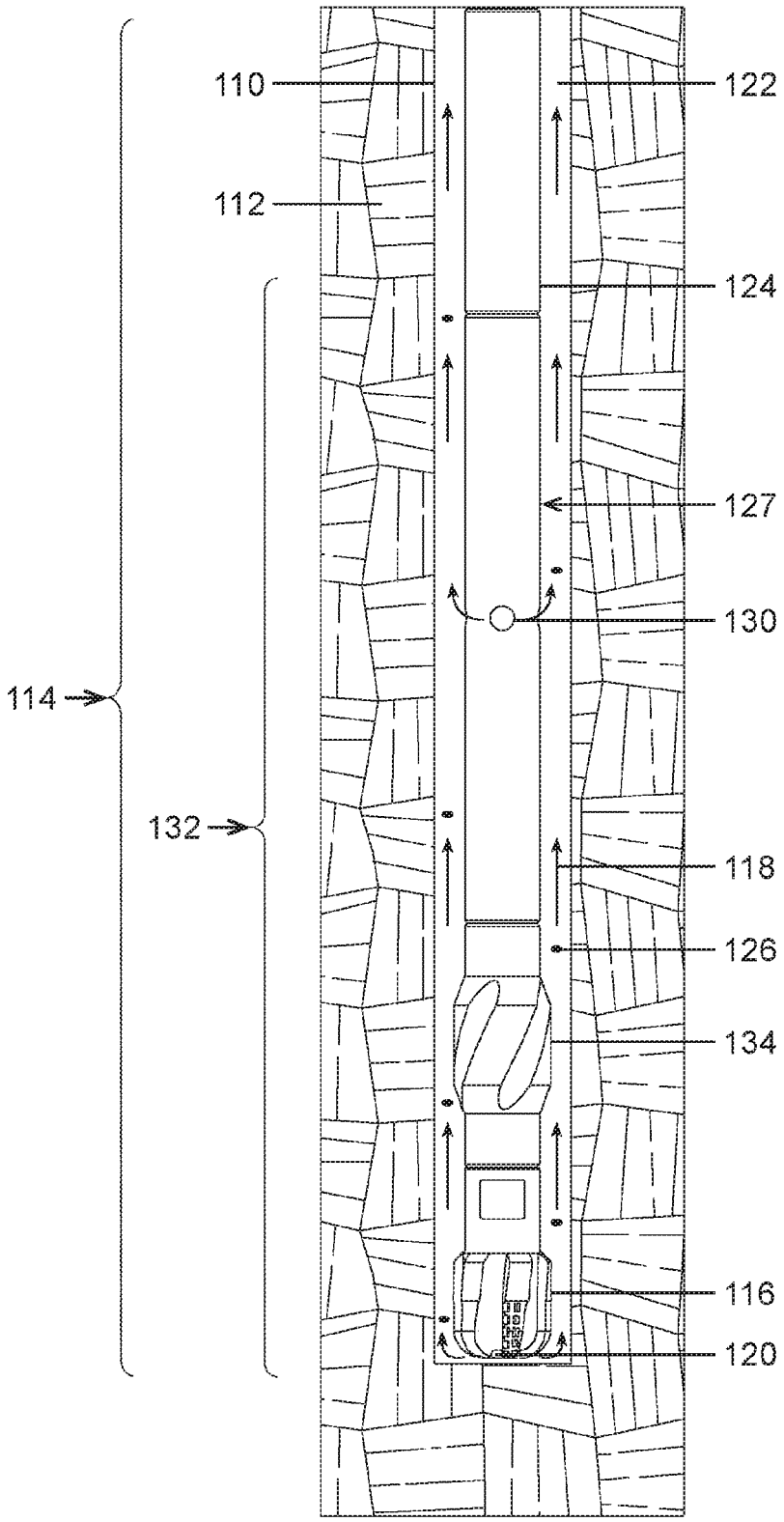

In the following description the terms 'up', 'down', 'upper', 'lower', 'above', 'below', 'upwards', 'downwards', 'top' and 'bottom' et cetera are relative to the orientation of the bore hole 110 and drill string 114 as shown in FIG. 1. It should be noted that a bore hole 110 may be drilled at any angle through the Earth's crust 112 and in some cases may be horizontal. Accordingly, the above relative terms can be interpreted with relation to the longitudinal axis of the drill string 114 and/or the downhole circulation tool, irrespective of its orientation, in which drilling mud 118 is delivered along the axis of the drill string 114 from a proximal, upstream or "upper" position to a distal, downstream or "lower" position. For example, the drill bit 116 can be described as at a distal or downstream position, and the downhole circulation tool receives drilling mud from a proximal or upstream position. Correspondingly, axial and radial orientations relate to the longitudinal axis of the circulation tool within the bore hole 110.

Figure 2A:
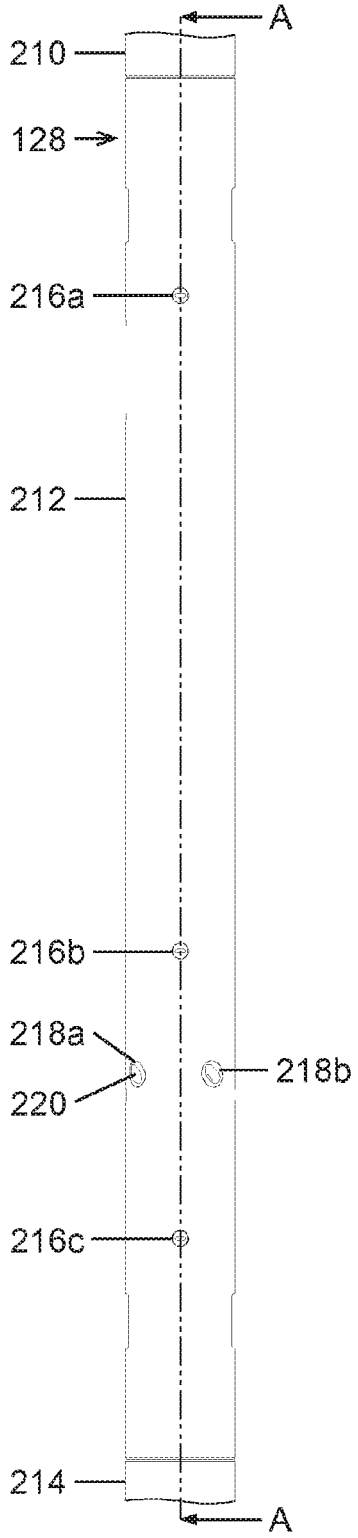

FIG. 2*a* shows a side view of a circulation tool 128 comprising a substantially tubular housing in which a plurality of fixed and movable internal components are disposed. The tubular housing itself is made up of three coupled tubular housing members including an upper housing member 210, a central housing member 212, and a lower housing member 214.

Three axially-spaced pairs of opposing retaining pins 216 (retaining pins 216*a*-216*c* are visible in FIG. 2*a*) extend through the central housing member 212 on a common plane extending through the longitudinal axis of the circulation tool 128 (i.e. the axis lies in the plane). The retaining pins 216 serve to retain a number of the internal components within the central housing member 212, as will be described in detail below.

Four hollow flow port inserts 218 (flow port inserts 218*a*, 218*b* visible in FIG. 2*a*) extend radially through the wall of the central housing member 212 at an axial position between the lower two pairs of retaining pins (216*b*, 216*c*), the flow port inserts 218 being angularly spaced apart at intervals of 90°. Each flow port insert 218 has a curved flow port passageway 220 shaped to direct drilling mud flowing therethrough upwards and outwards (tangentially and radially) in a swirling helical motion into the bore hole annulus. Drilling mud is only provided to flow through the flow ports 218 when the circulation tool 128 is set in a circulation position, as will be described in detail below. The flow port inserts 218 are typically composed of a hard erosion-resistant material, such as a suitable metal, alloy, ceramic or cermet.

Figure 2B:
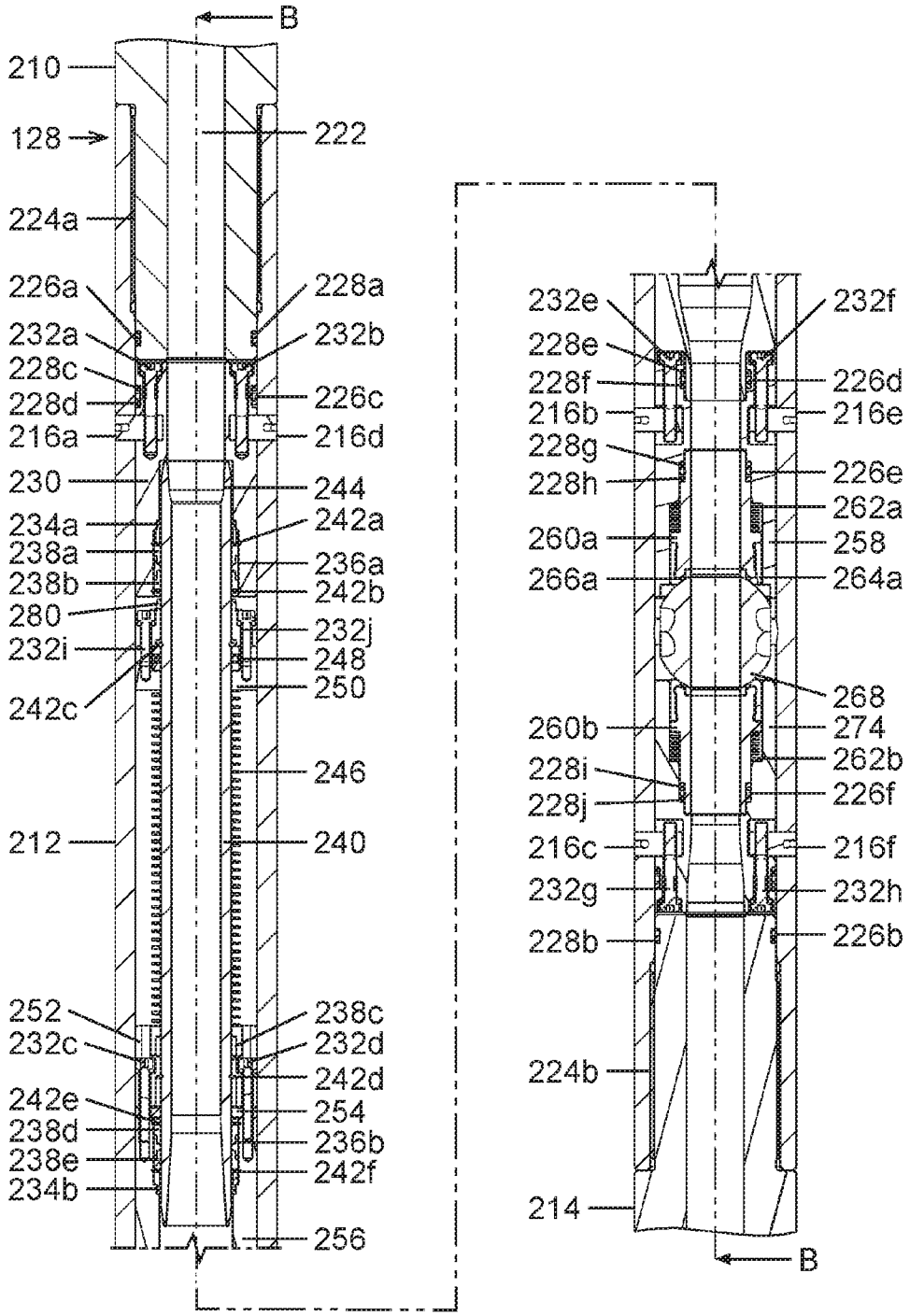
Figure 2C:
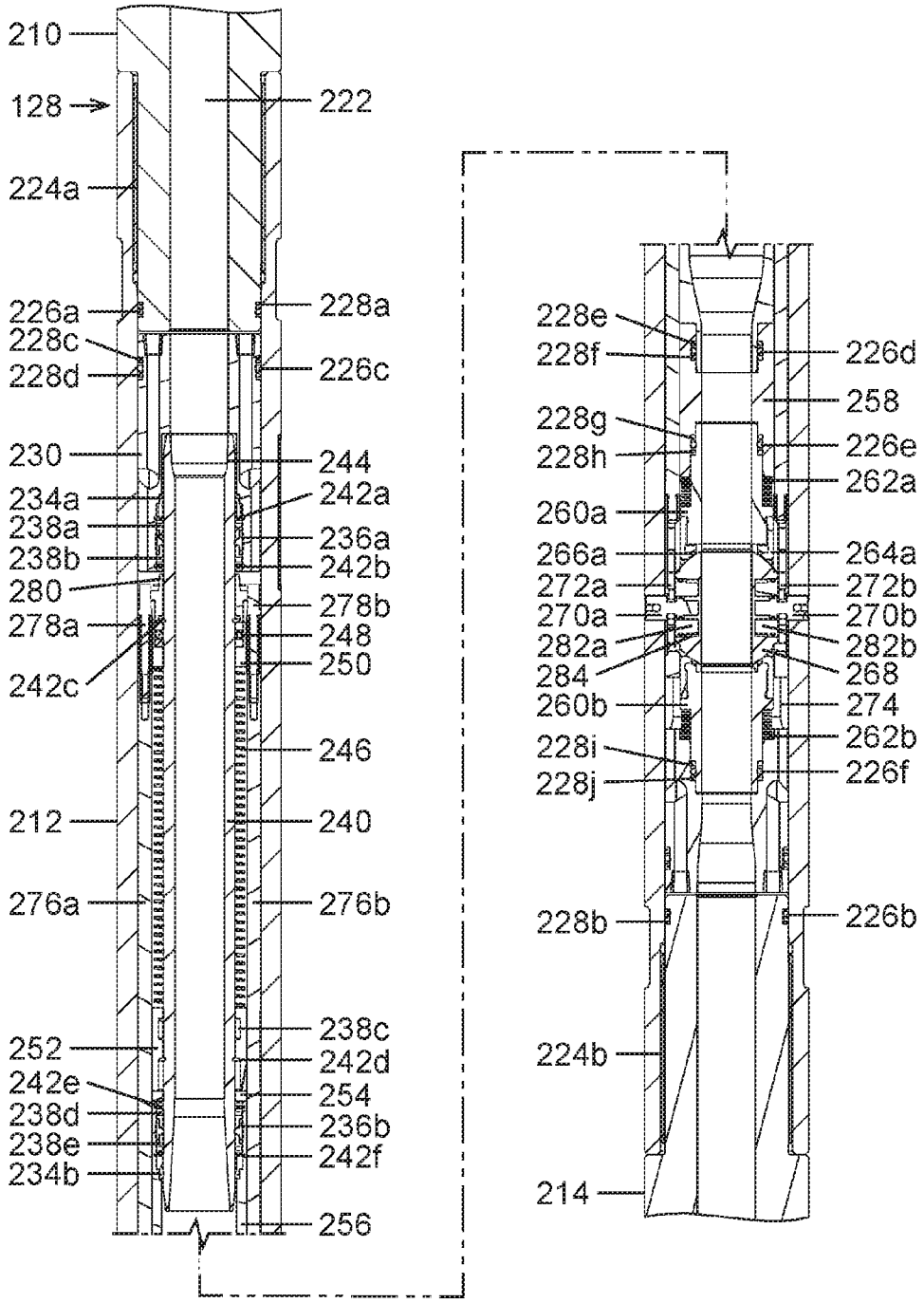

FIGS. 2*b* and 2*c* show cross-sectional views of the circulation tool 128 in a through-flow mode, with the internal components of the circulation tool 128 defining an axial delivery bore 222 for delivering drilling mud to a lower part of a drill string 114 in which the circulation tool 128 is disposed in use (not shown), such as a drill bit 116. The delivery bore 222 allows the unhindered passage of drilling mud axially through the circulation tool 128 in the through-flow position.

The upper and lower housing members 210, 214 are threadedly connected with respective upper and lower ends of the central housing member 212 using high strength threaded connectors 224*a*, 224*b*. Drilling mud is prevented from leaking through a clearance gap between the upper and lower housing members 210, 214 and central housing member 212 by O-ring seals 226*a*, 226*b*. The O-ring seals 226*a*, 226*b* may be composed of any suitable seal material, such as an elastomer, for example a Fluoroelastomer (FKM) or Perfluoroelastomer (FFKM). The O-ring seals 226*a*, 226*b* are prevented from being extruded through the clearance gap between the upper and lower housing members 210, 214 and the central housing member 212 by backup rings 228*a*, 228*b*. The backup rings 228*a*, 228*b* may be composed of any suitable material, such as a plastic, for example Polytetrafluoroethylene (PTFE) or Polyetheretherketone (PEEK).

An upper piston seal housing 230 is axially secured within the central housing member 212 by retaining pins 216*a*, 216*d*. The retaining pins 216*a*, 216*d* are retained within the upper piston seal housing 230 by socket cap screws 232*a*, 232*b* which extend axially through the upper piston seal housing 230, threading into the retaining pins 216*a*, 216*d*, at right angles to the axes of the retaining pins 216*a*, 216*d*. The upper piston seal housing 230 has an outer groove which is fitted with an O-ring seal 226*c* and backup rings 228*c*, 228*d* as described above with respect to the connections between the upper, lower and central housings 210, 214, 212. The O-ring seal 226*c* forms a pressure-tight seal between the upper piston seal housing 230 and the central housing member 212.

A counterbore is provided in the lower end of the upper piston seal housing 230, and is fitted with a scrapper seal 234*a*, T-seal 236*a* and wear rings 238*a*, 238*b* for receiving a tubular actuating piston member 240 which slidably extends therethrough and is axially displaceable relative to the upper piston seal housing 230. The scrapper seal 234*a* is configured to ensure the tubular actuating piston member 240 is kept clean and prevents debris from being forced past the T-seal 236*a* and wear rings 238*a*, 238*b* to prevent damage by debris. The wear rings 238*a*, 238*b* are configured to centralise the tubular actuating piston member 240, thereby allowing it to move smoothly. The scrapper seal 234*a* and wear rings 238*a*, 238*b* may be composed of plastic, such as PTFE or PEEK. The T-seal 236*a* provides a pressure tight seal between the upper piston seal housing 230 and the tubular actuating piston member 240. The T-seal 236*a* may be composed of an elastomer, such as FKM or FFKM. The scrapper seal 234*a*, T-seal 236*a* and wear rings 238*a*, 238*b* are retained in the upper piston seal housing 230 by retaining rings 242*a*, 242*b*.

The tubular actuating piston member 240 has an internal bore extending therethrough, and a frustoconical seat 244 at its upper end for catching and arresting the movement of an actuation element travelling down through the drill string in use. The seat 244 is in the form of a frustoconical inner wall (tapering downwardly) at the upper end of the internal bore of the tubular actuating piston member 240 which is configured to receive an actuation element sized to block the bore therethrough. Accordingly, in use when an actuation element is received on the seat 244, a flow of drilling mud through the tubular actuating piston member 240 is blocked, such that the tubular actuating piston member 240 and actuating element together form a piston.

The longitudinally displaceable tubular actuating piston member 240 is biased upwardly to a resting configuration in which it is stopped, as will be described below. The tubular actuating piston member 240 is biased by a compression spring disposed between a piston collar 250 mounted around and constrained to move with the tubular actuating piston member 240 towards its upper end and a spring seat 252 mounted within and constrained to move with the central housing member 212. The biasing force produced by the compressed spring 246 is transferred to the tubular actuating piston member 240 via a thrust bearing 248 within the piston collar 250, which itself is coupled to the tubular actuating piston member 240 via a retaining ring 242*c* received in an outer annular groove located towards the upper end of the tubular actuating piston member 240.

The lower end of the tubular actuating piston member 240 passes through internal bores of (in downward order) the spring seat 252, a shim plate 254 and a lower piston seal housing 256. The spring seat 252 and shim plate 254 are secured to the lower piston seal housing 256 by socket cap screws 232*c*, 232*d*, which thread into the lower piston seal housing 256. The spring seat 252 supports the biasing spring 246. The internal bore of the spring seat 252 has an internal groove fitted with a wear ring 238*c*. The wear ring 238*c* centralises the tubular actuating piston member 240, allowing it to slide smoothly in an axial direction in use. The wear ring 238*c* may be composed of plastic such as PTFE or PEEK.

The axial travel of the tubular actuating piston member 240 from the resting configuration is constrained by the depth of a counterbore in the lower end of the spring seat 252, which provides a space above the shim plate 254 in which a retaining ring 242*d* fitted within an external groove towards the lower end of the tubular actuating piston member 240 can ride. In the resting configuration, the retaining ring 242*d* abuts an upper shoulder of the counterbore in the lower end of the spring seat 252, whereas in a depressed configuration corresponding to the maximum axial travel of the tubular actuating piston member 240, the retaining ring 242*d* abuts the upper surface of the shim plate 254. The shim plate 254 therefore provides a lower stop, and the upper shoulder of the counterbore in the lower end of the spring seat 252 provides an upper stop for the travel of the tubular actuating piston member 240.

The lower piston seal housing 256 has a counterbore in its upper end for receiving the lower end of the tubular actuating piston member 240 and accommodating its axial travel. The counterbore is fitted with a scrapper seal 234*b*, a T-seal 236*b* axially above the scrapper seal 234*b*, and wear rings 238*d*, 238*e* axially either side of the T-seal 236*b*. The tubular actuating piston member 240 passes through the scrapper seal 234*b*, T-seal 236*b* and wear rings 238*d*, 238*e*, and penetrates into the counterbore in the lower piston seal housing 256. The scrapper seal 234*b* ensures the tubular actuating piston member 240 is kept clean and prevents debris from being forced past the T-seal 236*b* and wear rings 238*d*, 238*e* and causing damage in use. The wear rings 238*d*, 238*e* are configured to centralise the tubular actuating piston member 240, thereby allowing it to move smoothly in use. The scrapper seal 234*b* and wear rings 238*d*, 238*e* may be composed of any suitable material, such as a plastic, for example PTFE or PEEK. The T-seal 236*b* provides a pressure tight seal between the lower piston seal housing 256 and the tubular actuating piston member 240. The T-seal 236*b* may be composed of any suitable seal material, such as an elastomer, for example FKM or FFKM. The scrapper seal 234*b*, T-seal 236*b* and wear rings 238*d*, 238*e* are retained in the lower piston seal housing 256 by the retaining rings 242*e*, 242*f*.

Axially below the lower piston seal housing 256 and within the central housing member 212 there is provided a valve assembly comprising a ball valve member 268, upper and lower insert housings 258, 274 carrying upper and lower seal carrier piston members 260*a*, 260*b* respectively, as will be described in detail below.

The lower piston seal housing 256 forms a spigot connection with the upper insert housing 258. A counterbore at the upper end of the upper insert housing 258 has an internal groove which is fitted with an O-ring seal 226*d*, which forms a pressure tight seal between the lower piston seal housing 256 and the upper insert housing 258 at the spigot connection. The O-ring seal 226*d* may be composed of any suitable seal material, such as an elastomer, for example FKM or FFKM. To prevent the O-ring seal 226*d* being extruded through the spigot connection clearance gap, backup rings 228*e*, 228*f* are provided axially either side of the O-ring seal 226*d*, which may be composed of any suitable material, such as a plastic, for example PTFE or PEEK.

The upper insert housing 258 is axially secured within the central housing member 212 by retaining pins 216*b*, 216*e* extending through the central housing member 212 and received in corresponding recesses in the upper insert housing 258. The retaining pins 216*b*, 216*e* are retained within the upper insert housing 258 by socket cap screws 232*e*, 232*f* which extend axially through the upper insert housing 258, threading into retaining pins 216*b*, 216*e* along a direction perpendicular to the respective axes of the pins.

There is a double counterbore at the lower end of the upper insert housing 258 which receives a hollow seal carrier piston member 260*a*, biasing spring 262*a*, O-ring seal 226*e* and backup rings 228*g*, 228*h*. The seal carrier piston member 260*a* has an outer profile comprising two outer shoulders corresponding to the double counterbore in the lower end of the upper insert housing 258, so as to form a spigot connection therewith. The O-ring seal 226*e* and backup rings 228*g*, 228*h* are fitted above the upper shoulder of the seal carrier piston member 260*a*. The O-ring seal 226*e* forms a pressure tight seal between the upper insert housing 258 and the seal carrier piston member 260*a*. The O-ring seal 226*e* may be composed of any suitable seal material, such as an elastomer, for example FKM or FFKM. To prevent the O-ring seal 226*e* being extruded through the spigot connection clearance gap, backup rings 228*g*, 228*h* are provided, which may be composed of any suitable material, such as a plastic, for example PTFE or PEEK. The biasing spring 262*a* is a compression spring disposed between the lower lateral counterbore face (or shoulder) of the upper insert housing 258 and the lower shoulder on the seal carrier piston member 260*a* so as to urge the seal carrier piston member 260*a* against the ball valve member 268 to form a seal therewith.

The lower end of the seal carrier piston member 260*a* is fitted with a double seal arrangement comprising a primary seal 264*a* and a secondary resilient seal 266*a*. The primary seal 264*a* may be composed of metal, plastic or composite material whilst the secondary resilient seal 266*a* may be composed of an elastomer, such as FKM or FFKM. The primary seal 264*a* and the secondary resilient seal 266*a* are urged into contact with the ball valve member 268 under the biasing force of the biasing spring 262*a*. The biasing spring 262*a* ensures that a low pressure seal is maintained between the secondary resilient seal 266*a* and the ball valve member 268 when low pressure drilling mud flows through the circulation tool 128.

An area difference is created between the exposed upper end of seal carrier piston member 260*a* and the secondary seal 266*a*. This creates what is known to those skilled in the art as Double Piston member Effect (DPE) sealing. The drilling mud pressure acting over the area difference in use results in a pressure force acting downwardly on the seal carrier piston member 260*a*, thereby forming a high pressure seal between the primary seal 264*a* and the ball valve member 268.

As shown in FIG. 2*c*, in this embodiment trunnion pins 270*a*, 270*b* extend through the central housing member 212 on a common plane passing through the longitudinal axis of the circulation tool 128 (i.e. the longitudinal axis lies in the plane) and perpendicular to the plane on which the retaining pins 216*a*-216*f* are positioned. The trunnion pins 270*a*, 270*b* define a rotational axis for the ball valve member 268 and support the ball valve member 268 within the central housing member 212. The ball valve member is also supported by the upper and lower seal carrier pistons 260*a*, 260*b*. The trunnion pins 270*a*, 270*b* are retained in the central housing member 212 by sliders 272*a*, 272*b*. The trunnion pins 270*a*, 270*b* engage with overrunning clutch assemblies 282*a*, 282*b* fitted within cylindrical clutch pockets 284*a*, 284*b* on either side of the ball valve member 268, as will be described in detail below with reference to FIG. 3. In other embodiments, the ball valve member 268 may be supported by the seal carrier pistons 260*a*, 260*b* alone, and there may be no trunnion pins. Accordingly, the axis of the ball carrier valve 268 is defined by the position of the ball valve member 268 and the connection with the overrunning clutch assemblies 282*a*, 282*b*.

Referring back to FIG. 2*b*, the lower insert housing 274 and lower seal carrier piston member 260*b* are disposed below the ball valve member 268 and arranged in a corresponding but inverted manner as the upper insert housing 258 and upper carrier piston member 260*a* to support and seal with the ball valve member 268 from below.

The lower insert housing 274 is axially secured within the central housing member 212 by retaining pins 216*c*, 216*f* below the ball valve member 268. The retaining pins 216*c*, 216*f* are retained within the lower insert housing 274 by socket cap screws 232*g*, 232*h* which extend axially through the lower insert housing 274, threading into retaining pins 216*c*, 216*f*, at right angles to their respective axes. A double counterbore at the upper end of the lower insert housing 274 is fitted with a seal carrier piston member 260*b*, biasing spring 262*b*, O-ring seal 226*f* and backup rings 228*i*, 228*j*, as described above with respect to the upper insert housing 258 and upper seal carrier piston member 260*a*, albeit inversely oriented. Accordingly, the lower seal carrier piston member 260*b* is biased to form a pressure tight seal with the underside of the ball valve member 268 in the same manner as described above.

Referring again to FIG. 2*c*, the piston collar 250 (which is mounted to the tubular actuating piston member 240) is connected via axially extending push rods 276*a*, 276*b* to the sliders 272*a*, 272*b* disposed on either side of the ball valve member 268. The push rods 276*a*, 276*b* are secured to the piston collar 250 by threaded studs 278*a*, 278*b*. The threaded studs 278*a*, 278*b* are locked in position by a locking collar 280 disposed above and secured to the piston collar 250 by socket cap screws 232*i*, 232*j* (as shown in FIG. 2*b*). Accordingly, axial motion of the tubular actuating piston member 240 on reception of an actuation element is transmitted to the sliders 272*a*, 272*b* via the piston collar 250 and push rods 276*a*, 276*b*, as will be described in detail below.

Figure 3:
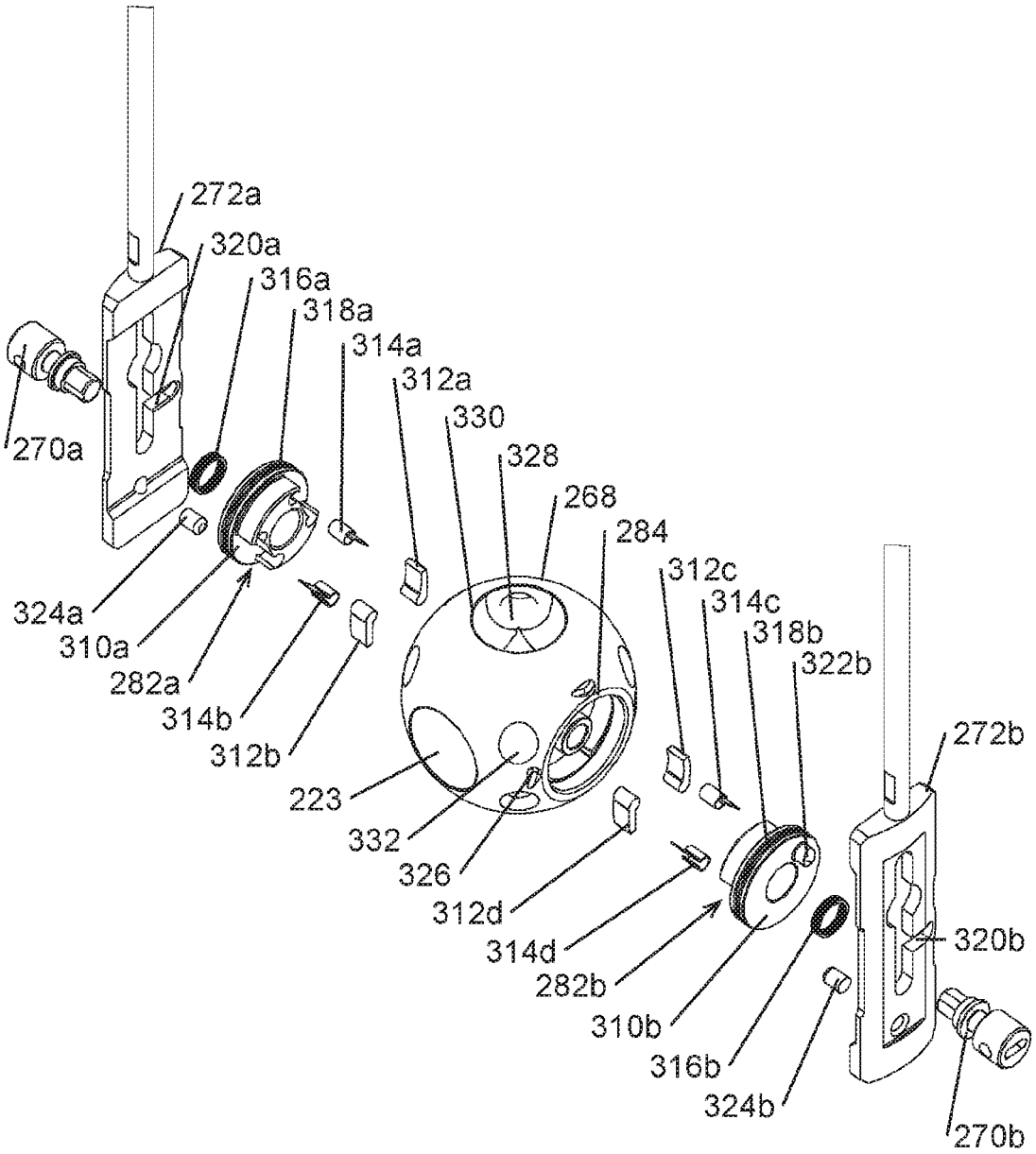
FIG. 3 shows an exploded isometric view of a unidirectional drive for rotating the valve member of the circulation tool.

FIG. 3 shows an exploded view of a unidirectional drive mechanism for rotating the ball valve member 268, comprising overrunning clutch assemblies 282*a*, 282*b* fitted within cylindrical clutch pockets 284 on either side of the ball valve member 268 to provide a unidirectional drive (or ratchet, or overrunning clutch mechanism).

In this embodiment, the clutch pockets 284 are integrally formed in the ball valve member 268, but in other embodiments the clutch pockets 284 may comprise an insert received in or mounted to the ball valve member 268. The clutch pockets 284 have a circumferentially extending saw tooth profile which provides four ratchet positions angularly spaced at 90° intervals around the rotational axis of the ball valve member 268 defined by the trunnion pins 270*a*, 270*b*. The saw tooth profile within the opposing clutch pockets 284 are aligned with each other (so they have the same overrunning direction).

The first overrunning clutch assembly 282*a* comprises a pawl carrier 310*a*, pawls 312*a*, 312*b*, pawl springs 314*a*, 314*b*, an inner pawl carrier seal 316*a*, and an outer pawl carrier seal 318*a*. The second overrunning clutch assembly 282*b* comprises a pawl carrier 310*b*, pawls 312*c*, 312*d*, pawl springs 314*c*, 314*d*, inner pawl carrier seal 316*b* and outer pawl carrier seal 318*b*. The overrunning clutch assemblies 282*a*, 282*b* will be described in detail with respect to the second overrunning clutch assembly 282*b*, the components of which are more clearly visible in FIG. 3 than the first overrunning clutch assembly 282*a*.

The trunnion pin 270*b* extends inwardly from the wall of the central housing member 212 through a slot in the slider 272*b* (as will be described below) and into the pawl carrier 310*b*, thereby supporting the overrunning clutch assembly 282*b* and the ball valve member 268 and defining the rotational axis of the ball valve member 268 and overrunning clutch assembly 282*b*. In other embodiments, there may be no trunnion pins, and the overrunning clutch assemblies 282*a*, 282*b* may be supported by virtue of their connection to the clutch pockets and the sliders 272*a*, 272*b*.

The pawl carrier 310*b* comprises a disc coaxially aligned with the rotational axis of the ball valve member 268, having an inner opening for receiving an inner pawl carrier seal 316*b* and the trunnion pin 270*b* and an outer cylindrical surface carrying an outer pawl carrier seal 318*b*. On the side of the pawl carrier 310*b* towards the ball valve member 268, the pawl carrier 310*b* comprises pawl slots for receiving rotating parts of the pawls 312*c*, 312*d*, and pawl spring slots for receiving rotating parts of the pawl springs 314*c*, 314*d*.

The inner pawl carrier seal 316*b* is configured to seal around the trunnion pin 270*b* to prevent debris from entering the overrunning clutch assembly 282*b* between the trunnion pin 270*b* and the pawl carrier 310*b* whilst allowing rotation. The inner pawl carrier seal 316*b* may comprise a labyrinth type seal. The outer pawl carrier seal 318*b* prevents debris from entering the overrunning clutch assembly 282*b* between the pawl carrier 310*b* and the ball valve member 268 whilst allowing rotation. The outer pawl carrier seal 318*b* may also be a labyrinth type seal.

The pawls 312*c*, 312*d* are mounted within the respective pawl slots of the pawl carrier 310*b* and are urged by pawl springs 314*c*, 314*d* received within the corresponding pawl spring slots to engage the teeth of the respective clutch pocket 284.

The clutch pocket 284 comprises four teeth, each having an angular extent of 90° of the saw-tooth profile, thereby providing four engagement features or tooth-edges against which a pawl may drive the clutch pocket 284 (and thereby the ball valve member 268) to rotate in an anticlockwise direction (viewed along the axis from trunnion pin 270*b* to 270*a*) as viewed in FIG. 3. Correspondingly, the pawl slots of the pawl carrier 310*b* and the pawls 312*c*, 312*d* are configured so that the distal end of each pawl extends in a generally anticlockwise direction, so as to be engageable with the tooth-edges of the clutch pocket 284.

The overrunning clutch assembly 282*b* is therefore configured to overrun in the clockwise direction (viewed along the axis from trunnion pin 270*b* to 270*a*) within the clutch pocket 284. Rotation of the overrunning clutch assembly 282*b* in the anti-clockwise engaging direction (viewed along the axis from trunnion pin 270*b* to 270*a*) will therefore cause the spring loaded pawls 312*c*, 312*d* to engage with the tooth-edges of the saw tooth profile of the clutch pocket 284 in one of the four ratchet positions, which are angularly spaced at 90° intervals. Once engaged in a ratchet position, further anti-clockwise rotation of the overrunning clutch assembly 282*b* will cause the ball valve member 268 to rotate in an anti-clockwise direction (viewed along the axis from trunnion pin 270*b* to 270*a*).

The first overrunning clutch assembly 282*a* and corresponding clutch pocket 284 is arranged in a corresponding but reflected manner as the second overrunning clutch assembly 282*b* and corresponding clutch pocket 284 described above, so that the overrunning clutch assembly 282*a* overruns in the clockwise direction of FIG. 3, and drives the ball valve member 268 to rotate in the anticlockwise direction when engaged in a ratchet position.

The sliders 272*a*, 272*b* each have a vertical slot for receiving the respective trunnion pins 270*a*, 270*b*, and respective horizontal slider slots 320*a*, 320*b* which engage with pawl carrier pins 322 (322*b* shown only) fitted to the pawl carriers 310*a*, 310*b* respectively in an eccentric position with respect to the rotational axis of the pawl carriers and ball valve member 268. The horizontal slider slots 320*a*, 320*b* and the pawl carrier pins 322 are configured so that upward translation of the sliders 272*a*, 272*b* drives the respective pawl carriers 310*a*, 310*b* to rotate in the anti-clockwise direction (viewed along the axis from trunnion pin 270*b* to 270*a*), whereas downward translation of the sliders 272*a*, 272*b* drives the respective pawl carriers 310*a*, 310*b* to rotate in the clockwise direction.

Slider locking pins 324*a*, 324*b* are fitted towards the lower end of the sliders 272*a*, 272*b* and configured to engage with corresponding locking pockets 326 of the ball valve member 268, angularly spaced from one another at 90° intervals. The slider locking pins 324*a*, 324*b* are configured to prevent the ball valve member 268 from rotating and overrunning in a clockwise direction (viewed along the axis from trunnion pin 270*b* to 270*a*) when the sliders 272*a*, 272*b* are positioned in an upper position corresponding to the resting configuration of the tubular actuating piston member 240.

The ball valve member 268 has a through-flow channel 223 which extends axially through the centre of the ball valve member 268 (i.e. from pole to pole) between antipodal openings in a direction orthogonal to the rotational axis of the ball valve member 268. The through-flow channel 223 is arranged to allow drilling mud to pass from an upstream portion of the delivery bore 222 to a downstream portion of the delivery bore 222 when the ball valve member 268 is in a through-flow position in which the through-flow channel 223 is aligned with the delivery bore 222.

Additionally, the ball valve member 268 has two circulation manifolds, each comprising four circulation channels (or circulation passageways) 328 which are unconnected to (i.e. do not intersect) the through-flow channel 223. Each circulation channel 328 of the respective manifold shares a common circulation inlet 330, and there are four separate circulation outlets or circulation ports 332 that exit the ball valve member 268.

The common circulation inlets 330 oppose one another (i.e. are antipodal with respect to each other), and are angularly spaced from the antipodal openings of the through-flow channel 223 by 90° with respect to the rotational axis of the ball valve member 268. The circulation manifolds are configured so that, when the ball valve member 268 is positioned in a circulation position in which one of the common circulation inlets 330 is aligned with the delivery bore 222 of the downhole circulation tool 128 (i.e. the bore extending through the tubular actuating piston member 240, upper insert housing 258 and upper seal carrier piston member 260*a*), the circulation outlets 332 align with the respective curved flow port passageways 220 within the flow port inserts 218*a*-218*d* fitted in the central housing member 212, thereby allowing drilling mud to flow from the delivery bore 222 into the bore hole annulus. In the circulation position, the through-flow channel 223 extends laterally so that does not receive drilling mud flow. Accordingly, the flow of drilling mud to the downstream portion of the delivery bore 222 is prevented.

Figure 4:
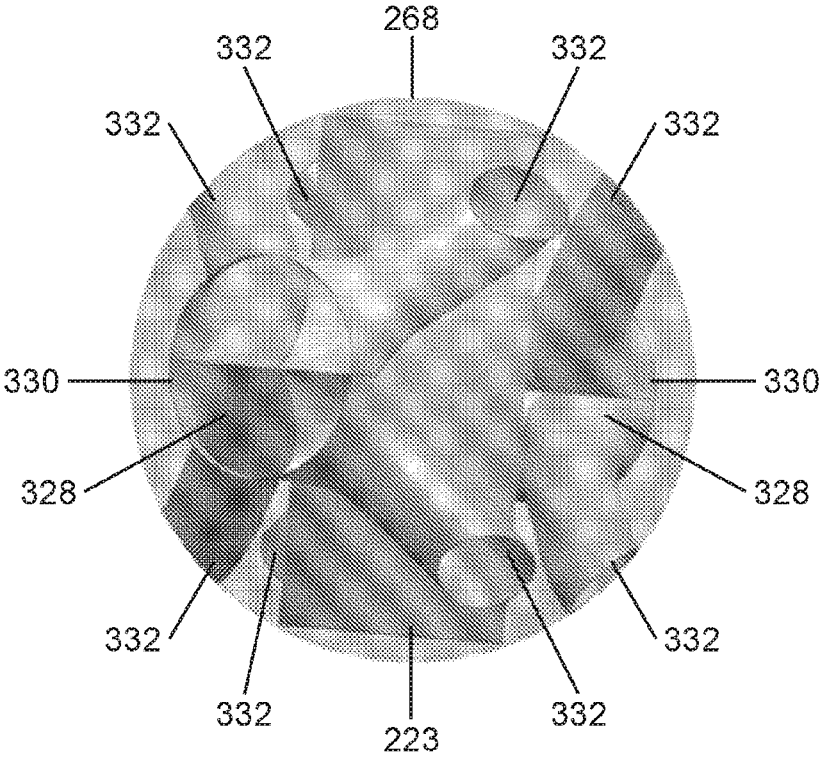
FIG. 4 shows a perspective view showing internal channels of the valve member of the circulation tool.

FIG. 4 shows an internal view of the through-flow channel 223 and circulation channels 328 within the ball valve member 268. The clutch pockets 284 have been omitted from this view for clarity. As shown, the circulation manifolds each have four circulation channels 328 sharing a common circulation inlet 330, but having four separate circulation outlets 332 that exit the ball valve member 268. Each circulation channel 328 is curved along its length to prevent flow separation, minimise pressure drop and reduce component erosion by a drilling mud flow flowing therethrough. The circulation channels and circulation ports (flow port passageways) are configured to partially reverse the drilling mud flow, such that the drilling mud flow is discharged from the circulation ports 220 along respective discharge directions having a component parallel and opposite to the upstream to downstream axial direction of the tool (i.e. an upward direction when the tool is oriented vertically).

Figure 5:
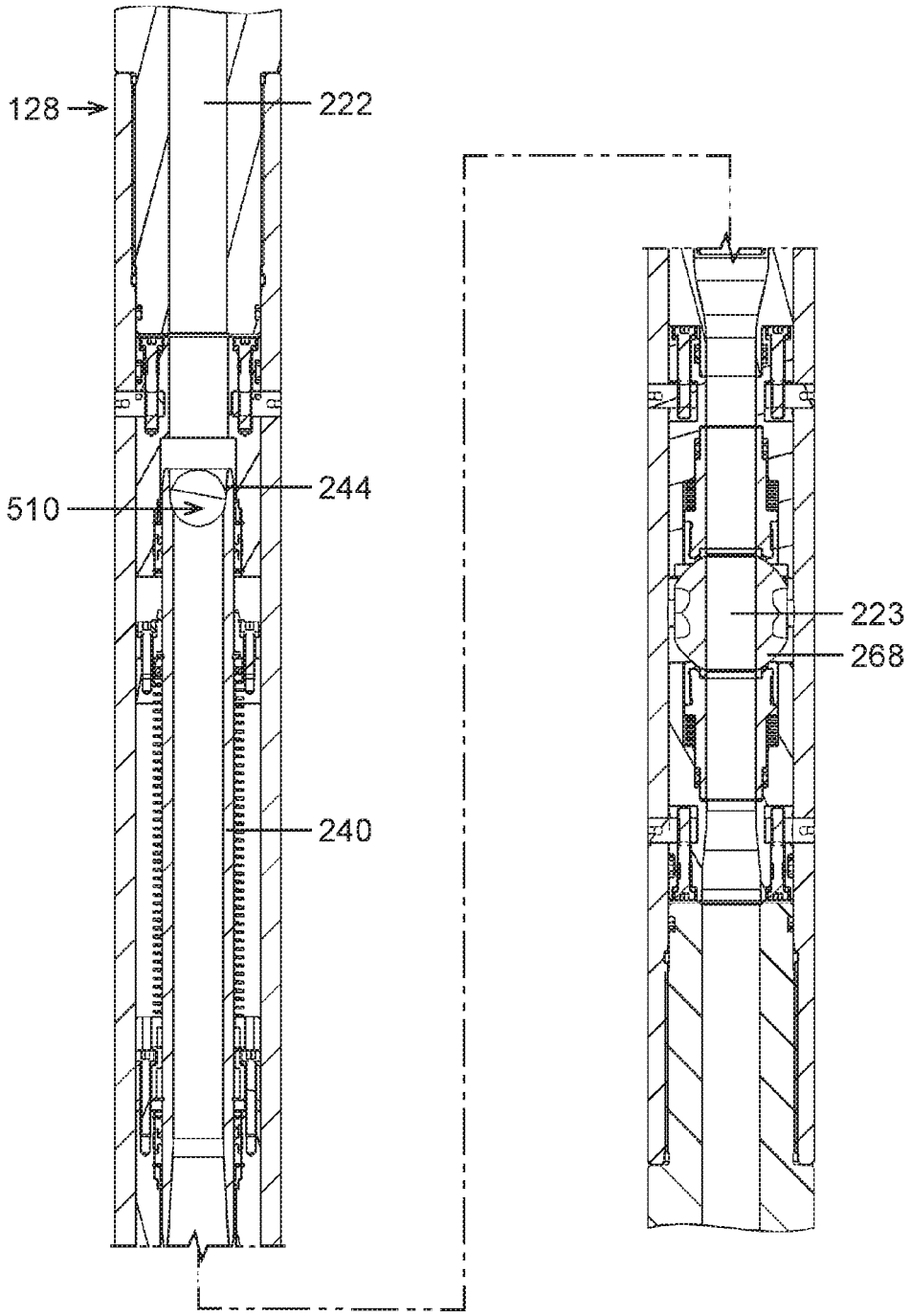
FIG. 5 shows a cross-sectional side view of the circulation tool in the through flow configuration (section along A-A of FIG. 2*a*), with the tubular actuating piston member in the depressed configuration.

In this embodiment, the actuation element or actuation ball 510 (as shown in FIG. 5) is a disintegratable spherical ball comprising a core or body surrounded by an outer protective coating for resisting damage and erosion during transit of the actuation element through the drill string 114. The disintegratable actuation element 510 is designed to have sufficient compressive strength to actuate the tubular actuating piston member 240 (as described below), but to subsequently disintegrate and break down within the drilling mud, so that it may pass through the downhole circulation tool 128, without the need for a ball-catcher.

In this embodiment, the inner core or body of the disintegratable actuation element 510 comprises an ionic compound such as salt (e.g. sodium chloride (NaCl) and/or potassium chloride (KCl)) and bentonite clay, in particular, sodium bentonite (sodium montmorillonite clay). In other embodiments, calcium carbonate, calcium sulphide or graphite may be used (additionally or alternatively to sodium chloride and/or potassium chloride).

The ionic surface of the phyllosilicate clay, bentonite, has the property of allowing the bentonite to bind to itself and to other pieces of bentonite (e.g. particles or aggregate form bentonite). This self-binding or self-sticky property of the bentonite allows the body or core of the disintegratable actuation element 510 to be formed under high-pressure compression within a die to form the hard disintegratable actuation element 510. This is in contrast to previously considered manufacturing methods for actuation balls, which typically rely on a binder material.

The precise composition of the body of the disintegratable actuation element 510 may depend on the pressure force which the disintegratable actuation element 510 must withstand in order to displace the tubular actuating piston member 240 from the resting configuration to the depressed configuration. For example, the disintegratable actuation element 510 may comprise between 5% and 60% bentonite by volume. 10% to 30% of bentonite by volume has been shown to be effective, in terms of an adequate strength and suitable disintegration time.

The self-binding or self-sticky property of the bentonite is activated in the presence of water, and typically requires hydration of at least 1% by weight for sufficient bonding strength. Sodium bentonite is considered by the applicant to provide the highest compressive strength of the various bentonite types (sodium, calcium and potassium bentonite), which may be because the sodium ions allow the montmorillonite flakes to separate and disperse, thereby giving uniform coating over individual particles.

A high bentonite composition (i.e. greater than 60% by volume) may result in over-swelling of the material of the disintegratable actuation element 510 (e.g. between 5 and 15 times the dry volume), which could therefore present a blockage in the drill string 114 if the disintegratable actuation element 510 does not disintegrate (and thereby wash away). Accordingly, a bentonite composition of less than 60% is desirable. In normal operation, the disintegratable actuation element 510 used with an 80 mm outer diameter circulation tool 128 has a diameter of approximately 27 mm before insertion into the drilling mud flow.

The disintegration of the disintegratable actuation element 510 can be controlled by adjusting the quantity of salt and filler material in the disintegratable actuation element 510, to moderate the self-stickiness of the bentonite. The filler material may be a powdered particulate, which may be non-abrasive, such as wood dust. When used with water based drilling muds, the salt dissolves in water and the filler material disperses and thereby allows the disintegratable actuation element 510 to break down. When used with oil-based drilling muds, the actuation element 510 may absorb the drilling mud, which may mechanically degrade the salt portions (comprising salt and filler material) and progress the disintegration of the actuation element 510.

Since both bentonite and salt (brines) are commonly used during drilling operations, their effects are well understood by the drilling industry and therefore the introduction of these materials into the drill string 114 in a disintegratable fashion will not present operational problems. Both bentonite and the above-mentioned salts have high melting points and compressive strengths, which makes them well suited to the high temperature and pressure environments found within deep bore holes 110.

FIG. 9 shows a cross-sectional view of the disintegratable actuation element 510 which in this embodiment comprises a core or body 511 surrounded by a protective outer coating 512. The protective outer coating 512 is resistant to high temperature (e.g. temperatures in excess 150° C.). Many different materials could be used for the protective outer coating 512, including temperature resistant resins (epoxides, glycidyl, oxirane groups, benzoxazines polyimides, bismaleimides and cyanate esters. Alternatively, the protective outer coating 512 may comprise a ceramic glaze material, such as silica-based coating. The protective outer coating 512 may be applied by dipping or spraying, for example.

The disintegratable actuation element 510 is produced by press-forming, for example using a tablet press known to those skilled in the art, which compresses granulated powder into spherical pills of uniform size and weight. In the press-forming method, granulated powder is poured into a cavity formed by two punches and a die. The punches are then pressed together, causing the material to fuse together to form a spherical pill or ball. The granulated powder may be composed of calcium carbonate, sodium chloride, potassium chloride, sodium bentonite (powdered drilling mud) or a combination thereof. The spherical pill is then coated with a protective outer coating 512.

A method of actuating the downhole circulation tool 128 will now be described, by way of example.

FIGS. 2*b* and 2*c* show cross-sectional views of the downhole circulation tool 128 with the tubular actuating piston member 240 in the resting configuration and the ball valve member 268 in the through-flow position. Drilling mud is pumped down through the delivery bore 222 of the downhole circulation tool 128, and passes through the tubular actuating piston member 240 (including the seat 244), and the ball valve assembly including the through-flow channel 223 of the ball valve member 268. The drilling mud therefore reaches the BHA 132, and is ejected through the jetting nozzles 120 to wash the drilling cuttings 126 away from the drill bit 116.

In order to actuate the ball valve member 268 to move to the circulation position, a disintegratable actuation element 510 is added to the drilling mud flow so that it is received on the seat 244 of the tubular actuating piston member 240, as shown in FIG. 5. As shown in FIG. 5, the downhole circulation tool 128 remains in the through-flow position as the tubular actuating piston member 240 begins to be displaced downwardly from the resting configuration under the pressure force acting on the disintegratable actuation element 510 and tubular actuating piston member 240 owing to the blocked bore.

Since the sliders 272*a*, 272*b* are connected to the tubular actuating piston member 240 via the piston collar 250 and push rods 276*a*, 276*b*, the sliders 272*a*, 272*b* also move downwards with the tubular actuating piston member 240, thereby causing the pawl carrier pins 322*a*, 322*b* (as shown in FIG. 3) to move laterally in the horizontal slots 320*a*, 320*b* of the sliders 272*a*, 272*b*, such that the pawl carrier pins 322*a*, 322*b* and the pawl carriers 310*a*, 310*b* to which they are attached rotate in a clockwise direction. This rotation causes the pawls 312 to overrun the saw-tooth profile of the clutch pockets 284.

The overrunning clutch assemblies 282 are configured to correspond to the axial travel of the tubular actuating piston member 240 so that the pawls 312 do not overrun a tooth-edge of the saw-tooth profile of the clutch pockets 284 until the tubular actuating piston member 240 has travelled at least a piston displacement threshold, which in this embodiment corresponds to approximately 90% of the full travel (as limited by the retaining ring 242*d* moving within the counterbore of the spring seat 252 up to the shim plate 254). In other embodiments, the threshold displacement may correspond to substantially 100% of the travel, such that it is not possible to depress the tubular actuating piston member 240 beyond the threshold piston displacement.

Accordingly, as the drilling mud continues to be pumped, the pressure force rises to overcome the biasing force of the biasing spring 246 and associated friction forces, so that the tubular actuating piston member 240 is displaced to the piston displacement threshold, at which point the pawls 312 overrun the respective tooth-edges to arrive at a ratchet position in which the pawls 312 engage the respective tooth-edges. Accordingly, subsequent anticlockwise rotation of the pawls 312 drives the clutch pockets 284 and thereby the ball valve member in the anti-clockwise direction. It will be appreciated that in other embodiments the saw-tooth profiles may be configured so that, after overrunning a tooth-edge, a degree of rotation in the opposite direction is required before the pawls 312 engage the tooth-edge.

Further pumping of the drilling mud causes the disintegratable actuation element 510 to become over-pressurised, thereby causing it to fracture or disintegrate. Partial fracture and/or of the actuation element results in rupture of the protective outer coating 512, which exposes the body of the actuation element and accelerates its disintegration.

Once the disintegratable actuation element 510 has been fractured, it is pumped through the upstream portion of the delivery bore 222, including the through-flow channel 223 of the ball valve member 268, so that the delivery bore 222 is no longer blocked. The disintegrated parts of the disintegratable actuation element 510 are discharged through the jetting nozzles 120 in the drill bit 116.

Consequently, the tubular actuating piston member 240 rises under the biasing force of the biasing spring 246 from the depressed configuration to the resting configuration, thereby causing corresponding movement of the sliders 272*a*, 272*b*. The upwards movement of the sliders causes the overrunning clutch assemblies 282*a*, 282*b*, now with pawls 312 engaged in respective ratchet positions, to rotate in the anticlockwise direction and drive corresponding rotation of the ball valve member 268 through 90° in an anti-clockwise direction (viewed along the axis from trunnion pin 270*b* to 270*a*), thereby positioning the ball valve member 268 in the circulation position. The ball valve member 268 is rotated through 90° because the tubular actuating piston member 240 is configured so that travel from the piston displacement threshold to the resting configuration when the clutch is engaged (i.e. the pawls 312 are engaged with the tooth-edges) corresponds to 90° of anticlockwise rotation. Even if the tubular actuating piston member 240 is displaced beyond the piston displacement threshold by an additional displacement amount, the additional displacement amount only corresponds to overrunning clockwise rotation of a pawl beyond a ratchet position, and so will not result in anti-clockwise rotation of the ball valve member 268 of more than 90°, as the pawl 312 simply moves back to the ratchet (or engaged) position when the tubular actuating piston member 240 moves back over the additional displacement amount to the threshold piston displacement.

As the sliders 272*a*, 272*b* return to their upper positions corresponding to the resting configuration of the tubular actuating piston member 240, the slider locking pins 324*a*, 324*b* engage with respective locking pockets 326 on either side of the ball valve member 268, thereby preventing the ball valve member 268 from rotating and overrunning in anti-clockwise direction (viewed along the axis from trunnion pin 270*b* to 270*a*).

FIGS. 6*a* and 6*b* show the circulation tool 128 with the ball valve member 268 in the circulation position, and with the tubular actuating piston member 240 returned to the resting configuration. FIG. 6*b* shows a cross-sectional view of the circulation tool 128 taken along a section which cuts through the flow port passageways 220 within the flow port inserts 218*a*-218*d*. With the ball valve member 268 in the circulation position, the drilling mud from the upstream portion of the delivery bore 222 is smoothly redirected through the curved circulation channels 328 of the ball valve member 268 and subsequently through the curved flow port passageways 220 such that it is reversed from a downwards direction to an (at least partly) upwards direction, and so that both radial and tangential components are imparted on the flow to produce a helical flow within the bore hole annulus 122. The drilling mud therefore strikes the bore hole 110 at an oblique angle. This helical flow improves the removal and transportation of drilling cuttings 126 from the bore hole annulus 122 and helps maintain bore hole 110 stability.

The gradual turning of the drilling mud through the circulation channels 328 of the ball valve member 268 ensures flow separation is minimised, reducing the likelihood of erosion or washing within the ball valve member 268 and flow port passageways 220. By avoiding separated flow, the pressure losses through the circulation tool 128 are minimized, thereby reducing the surface equipment pressure requirements, or alternatively allowing higher drilling mud flow rates to be achieved with the same pressure (when compared to existing circulation tools). The use of higher drilling mud flow rates may provide more effective removal of drilling cuttings 126 from the bore hole annulus 122.

Unlimited actuation between the through-flow and circulation positions is achieved by dropping successive disintegratable actuation elements 510 into the drill string 114, which causes the ball valve member 268 to rotate anticlockwise through 90° with each actuation. Each successive 90° rotation causes a common circulation inlet 330 or an opening of the through-flow channel 223 to align with the upstream portion of the delivery bore 222.

If the disintegratable actuation element 510 is pumped too fast or is damaged during transit, it will be blown through the seat 244 and delivery bore 222, and the tubular actuating piston member 240 will remain stationary in the resting configuration or will be displaced but not reach the piston displacement threshold, thereby ensuring that the circulation tool 128 remains un-actuated if the disintegratable actuation element 510 disintegrates too soon.

The ball valve member 268 is configured so that, when it is in the through-flow position, the circulation outlets 332 do not align with the flow port passageways 220, thereby preventing debris from entering the circulation channels 328 and avoiding the likelihood of debris fouling the rotation of the ball valve member 268.

The displacement of the tubular actuating piston member 240 is damped by a damping force acting on the piston collar 250 and locking collar 280 within the central housing member 212. The damping force is due to a damping medium, e.g. grease, oil, drilling mud or a similar fluid disposed within the central housing member 212. Damping the displacement of the tubular actuating piston member 240 causes the ball valve member 268 to rotate slowly between configurations, thereby giving the operator time to stop the drilling mud flow, and avoiding any potential water hammer effects and any potential for high velocity erosion of the ball valve member 268. The operator can determine when to stop the drilling mud flow based on pressure and flow rate monitoring, and knowledge of the time required for the ball valve member 268 to rotate, as determined by the (predetermined) damping of the displacement of the tubular actuation piston member 240. To ensure the pressure of the fluid in the central housing member 212 remains equal to pressure within the bore hole annulus 122 (i.e. a pressure differential is not set up), the central housing member 212 is vented to the bore hole annulus 122 via a floating pressure compensation piston (not shown).

In a second embodiment of the downhole circulation tool 128, an upper section of the circulation tool 128 is provided with a means for electromagnetically actuating the circulation tool 128, as shown in FIG. 7.

In the second embodiment, all components below the locking collar 280 remain unchanged from the first embodiment described above. However, the central housing member 212 is lengthened and the upper piston seal housing 230 is replaced by an upper seal insert 710, electromagnetic actuator assembly 712, thrust insert 714, battery pack 716 and control module 718. As in the first embodiment, there is a tubular actuating piston member 240 coupled to the piston collar 250, which allows the overrunning clutch assembly 282 to be driven by an actuation element, such as a disintegratable actuation element 510, as an alternative to electromagnetic actuation.

The electromagnetic actuator assembly 712 is positioned above the upper seal insert 710. The electromagnetic actuator assembly 712 comprises a high torque electric motor which drives a hollow lead screw 720. The lower end of the hollow lead screw 720 is arranged to contact the upper end of the tubular actuating piston member 240.

The thrust insert 714 is axially secured within the central housing member 212 by retaining pins 216*a*, 216*d*. The retaining pins 216*a*, 216*d* are retained within the thrust insert 714 by socket cap screws 232*a*, 232*b* which extend axially through the thrust insert 714, threading into the retaining pins 216*a*, 216*d*, at right angles to their respective axes. The thrust insert 714 provides a reaction to the thrust force produced by the electromagnetic actuator assembly 712.

Above the thrust insert 714 there is disposed the battery pack 716 and control module 718. The battery pack 716 provides power to the control module 718 and electromagnetic actuator assembly 712. The control module 718 may contain actuation sensors, antennas, power regulators and microprocessors as needed to control the electromagnetic actuator assembly 712. The actuation sensors may include but not be limited to pressure sensors, wireless sensors, accelerometers and gyros.

In use of the circulation tool 128 according to the second embodiment, an actuation command signal is received by the control module 718 and an actuation signal is sent to the electromagnetic actuator assembly 712 which causes the hollow lead screw 720 to actuate downwards. Since the lower end of the hollow lead screw 720 contacts the upper end of the tubular actuating piston member 240, the tubular actuating piston member 240 is depressed downwards. The electromagnetic actuator assembly 712 is subsequently controlled so that the hollow lead screw 720 is drawn upwards once more.

Since the mechanical components below the upper seal insert 710 remain the same as the previously described embodiment, the actuation of the ball valve member 268 occurs in the same manner. Unlimited actuation between the through-flow and circulation positions is achieved by successive actuation of the electromagnetic actuator assembly 712, which causes the ball valve member 268 to rotate through 90° with each actuation.

The actuation command signal may be sent after a pre-set time delay or sent to the control module 718 from the surface by an electrical command wire, mud pulse, drill string mechanical jarring or via an electronic actuation tag, which may be detected by respective sensors.

The circulation tool 128 can also be actuated an unlimited number of times by dropping successive disintegratable actuation elements 510, as described above.

In a third embodiment of the downhole circulation tool 128, the upper section of the circulation tool 128 is provided with a means for actuating the tool using mud pressure from the bore hole annulus 122, as shown in FIG. 8.

In this third embodiment, all components below the locking collar 280 remain unchanged from the first embodiment. However, the central housing member 212 is lengthened and has the addition of two small pressure actuation ports 810 which vent to the bore hole annulus 122 Further, the upper piston seal housing 230 is replaced by a nitrogen actuation assembly 812.

The nitrogen actuation assembly 812 comprises an upper seal insert 814 threaded into a lower nitrogen reservoir sleeve 816, both disposed around the tubular actuating piston member 240. Fitted within the nitrogen reservoir sleeve 816 and extending from the upper seal insert 814 there is an actuation plunger 818. O-ring gas seals 820 allow a gas tight annular nitrogen cavity 822 to be formed between the nitrogen reservoir sleeve 816 and the actuation plunger 818. The annular nitrogen cavity 822 is filled with pressurised nitrogen which biases the actuation plunger 818 upwardly, overcoming the hydrostatic pressure communicated through the pressure actuation ports 810 from the bore hole annulus 122, to which the upper end of the actuation plunger 818 is exposed. The nitrogen pressure within the annular nitrogen cavity 822 is set according to the required actuation depth of the circulation tool 128. The tubular actuating piston member 240 is configured to slide through the actuation plunger 818.

The nitrogen actuation assembly 812 is axially secured within the central housing member 212 through the upper seal insert 814 using retaining pins 216*a*, 216*d*. The retaining pins 216*a*, 216*d* are retained within the upper seal insert 814 by socket cap screws 232*a*, 232*b* which extend axially through the upper seal insert 814, threading into the retaining pins 216*a*, 216*d* at right angles to their respective axes.

In use, actuation between the though-flow and circulation positions is achieved by using mud pressure from the bore hole annulus 122.

The circulation tool 128 is actuated by increasing the pressure in the bore hole annulus 122 from the surface. The increased pressure is communicated through the pressure actuation ports 810 and on to the upper end of the actuation plunger 818, which causes it to move downwards when the pressure overcomes the nitrogen pressure in the annular nitrogen cavity 822. The actuation plunger 818 is thereby brought into contact with the upper end of the locking collar 280, and further downward movement of the actuation plunger 818 causing the tubular actuating piston member 240 to be pushed downwards.

Since the mechanical components below the upper seal insert 710 remain the same as the previously described embodiment, the actuation of the ball valve member 268 occurs in the same manner. Unlimited actuation between the through-flow and circulation positions is achieved by successive re-pressurisation of the drilling mud in the bore hole annulus 122, which causes the ball valve member 268 to rotate through 90° with each actuation as described above.

As previously described, the circulation tool 128 can also be actuated an unlimited number of times by dropping successive disintegratable actuation elements 510.

The circulation tool of the disclosure is more efficient and reliable than previously considered circulation tools, and can be used an unlimited number of times without penalty when drilling bore holes.

It will be appreciated that while the above descriptions contain specific features relating to the configuration of the circulation tool and the specific components therein, these relate to particular embodiments. It will be appreciated that additional embodiments may use alternative means to affect actuation of the ball valve member within the circulation tool. These may include but not be limited to electromagnetic means, hydraulic means, mechanical means, pneumatic means, etc. The particular means of actuating the ball valve member does not impact other aspects of the disclosure.

Although aspects of the disclosure relating to a downhole tool having a unidirectional drive mechanism and a movable tool device movable between multiple positions have been described in relation to the actuation of a ball valve member for a circulation tool, it will be appreciated that such aspects are applicable to other downhole tool devices. In particular, the unidirectional drive mechanism may be employed with respect to tool devices including hole openers/reamers, adjustable gauge stabilisers, rotary steerable systems, shut-off ball valves or blow out preventers, and disconnect tools.

The invention claimed is:

1. A downhole circulation tool comprising:

a housing having an axially extending delivery bore for conveying a drilling mud flow therethrough, the housing having a circulation port for discharging drilling mud; and a valve member rotatably disposed within the housing, the valve member comprising a through-flow channel and a circulation channel;

wherein the valve member is rotatable between a through-flow position in which the through-flow channel is arranged to convey drilling mud flow from an upstream portion of the delivery bore to the downstream portion of the delivery bore, and a circulation position in which the circulation channel is arranged to convey drilling mud from the upstream portion of the delivery bore to the circulation port to discharge drilling mud from the housing;

wherein the circulation channel and through-flow channel of the valve member do not intersect one another.

2. A downhole circulation tool according to claim 1, wherein the valve member is a ball valve member.

3. A downhole circulation tool according to claim 1, wherein the valve member is configured to prevent drilling mud flow to the downstream portion of the delivery bore.

4. A downhole circulation tool according to claim 1, wherein there are a plurality of circulation channels, each arranged to deliver drilling mud to a respective circulation port in the housing when the valve member is in the circulation position.

5. A downhole circulation tool according to claim 1, wherein the or each circulation channel is arranged to turn the drilling mud flow flowing therethrough such that, in use, drilling mud is discharged to the respective circulation port along a circulation channel discharge direction having an axial component parallel and opposite to the direction of flow in the axially extending delivery bore.

6. A downhole circulation tool according to claim 1, wherein the or each circulation channel is configured so that, in use in the circulation position, drilling mud is discharged to the respective circulation port along a circulation channel discharge direction having a tangential component.

7. A downhole circulation tool according to claim 1, wherein the or each circulation channel is curved along its length.

8. A downhole circulation tool according to claim 1, wherein an opening of the through-flow channel and the or each circulation inlet are angularly spaced apart by substantially 90° with respect to a rotational axis of the valve member.

9. A downhole circulation tool according to claim 1, wherein there is a first circulation channel and a second circulation channel each having respective circulation inlets, wherein the first and second circulation channels do not intersect one another, and wherein the circulation inlet of the second circulation channel is antipodal with respect to the circulation inlet of the first circulation channel.

10. A downhole circulation tool according to claim 1, wherein the valve member comprises a plurality of circulation channels and wherein there are a corresponding plurality of circulation ports in the housing.

11. A downhole circulation tool according to claim 1, wherein the or each circulation port is configured to turn a drilling mud flow flowing therethrough.

12. A downhole circulation tool according to claim 1, wherein the or each circulation port is configured to discharge drilling mud along a port discharge direction having a tangential component and an axial component parallel and opposite to the direction of flow in the axially extending delivery bore.

13. A downhole circulation tool according to claim 1, wherein a component defining an upstream portion of the delivery bore adjacent to the valve member and/or a component defining a downstream portion of the delivery bore adjacent to the valve member is configured to seal with the valve member.

14. A downhole circulation tool according to claim 1, wherein the circulation channel is further defined as two circulation channels, the circulation channels sharing a common inlet and having separate outlets.

15. A downhole circulation tool according to claim 1, wherein the delivery bore has a diameter at the valve member, the through-flow channel has an inlet having the same diameter as the delivery bore at the valve member, and the circulation channel has an inlet having the same diameter as the delivery bore at the valve member.

* * * * *